US010149562B2

(12) United States Patent
Bell et al.

(10) Patent No.: US 10,149,562 B2
(45) Date of Patent: Dec. 11, 2018

(54) STACKABLE DRINKWARE

(71) Applicant: CATA, LLC, Whitefish Bay, WI (US)

(72) Inventors: Jessica L. Bell, Whitefish Bay, WI (US); Garet K. Galster, Oconomowoc, WI (US)

(73) Assignee: CATA, LLC, Whitefish Bay, WI (US)

( * ) Notice: Subject to any disclaimer, the term of this patent is extended or adjusted under 35 U.S.C. 154(b) by 392 days.

(21) Appl. No.: 14/952,054

(22) Filed: Nov. 25, 2015

(65) Prior Publication Data

US 2016/0073811 A1 Mar. 17, 2016

Related U.S. Application Data

(63) Continuation-in-part of application No. PCT/US2015/024213, filed on Apr. 3, 2015.

(60) Provisional application No. 61/987,901, filed on May 2, 2014, provisional application No. 61/974,731, filed on Apr. 3, 2014.

(51) Int. Cl.

| | |
|---|---|
| ***A47G 19/23*** | (2006.01) |
| ***B65D 8/00*** | (2006.01) |
| ***B65D 21/02*** | (2006.01) |
| ***B65D 1/26*** | (2006.01) |
| ***A47G 19/22*** | (2006.01) |

(52) U.S. Cl.

CPC ..... *A47G 19/23* (2013.01); *A47G 19/2205* (2013.01); *A47G 19/2227* (2013.01); *A47G 19/2255* (2013.01); *B65D 1/265* (2013.01); *B65D 11/02* (2013.01); *B65D 11/04* (2013.01); *B65D 21/0233* (2013.01)

(58) Field of Classification Search

CPC ..... A47G 19/23; A47G 19/2205; A47G 19/2227; A47G 19/2255; A47G 2019/2277; B65D 1/265; B65D 11/02; B65D 11/04; B65D 21/0233

See application file for complete search history.

(56) References Cited

U.S. PATENT DOCUMENTS

| | | | |
|---|---|---|---|
| 640,860 | A | 1/1900 | Baum |
| 1,725,265 | A | 8/1924 | Glendinning |
| D170,289 | S | 8/1953 | Skipp |
| 2,765,832 | A | 10/1956 | Tupper |
| 3,215,300 | A | 11/1965 | Lynch |
| 3,289,822 | A | 12/1966 | Schumer et al. |

(Continued)

FOREIGN PATENT DOCUMENTS

WO 2010/132688 A2 11/2010

OTHER PUBLICATIONS

Jessica Bell, presentation posted online at https://www.youtube.com/watch?v=iVafyM58m9o, Oct. 28, 2015.

*Primary Examiner* — Anthony Stashick
*Assistant Examiner* — James Way
(74) *Attorney, Agent, or Firm* — Bell & Manning, LLC

(57) ABSTRACT

Stackable drinkware includes a mouth having a mouth diameter and a maximum cavity diameter, wherein the mouth diameter is less than the maximum cavity diameter. The drinkware includes a vessel having a closed bottom and open top, and a chute including an open bottom and open top, wherein the open bottom of the chute is coupled to the open top of the vessel. A sealed vessel or chute pre-filled with fluid may be provided, which may be opened and coupled to a mateable chute or vessel, respectively.

23 Claims, 18 Drawing Sheets

(56) References Cited

U.S. PATENT DOCUMENTS

| | | | | |
|---|---|---|---|---|
| 3,307,602 | A | 3/1967 | Boster | |
| 3,362,575 | A | 1/1968 | Fotos | |
| 3,405,862 | A | 10/1968 | Spyra | |
| 3,441,173 | A | 4/1969 | Edwards | |
| 3,464,587 | A | 9/1969 | Edwards | |
| 3,730,385 | A | 5/1973 | Rost | |
| 3,912,118 | A | 10/1975 | Bird | |
| 3,915,296 | A | 10/1975 | Spencer | |
| 3,995,740 | A | 12/1976 | Amberg | |
| D269,765 | S | 7/1983 | Fortuna | |
| D272,223 | S | 1/1984 | Daenen | |
| D281,303 | S | 11/1985 | Fortuna | |
| D285,656 | S | 9/1986 | Champion | |
| 4,823,958 | A | 4/1989 | Mahmud | |
| 4,832,212 | A | 5/1989 | Askinazi | |
| 4,932,554 | A | 6/1990 | Smith | |
| 4,938,373 | A | 7/1990 | McKee | |
| 5,071,042 | A | 12/1991 | Esposito | |
| D334,113 | S | 3/1993 | Lewis et al. | |
| D410,364 | S | 6/1999 | Ramirez et al. | |
| D417,847 | S | 12/1999 | Rush et al. | |
| 6,082,575 | A | 7/2000 | Skoskiewicz | |
| 6,409,038 | B1 | 6/2002 | Karp | |
| D465,384 | S | 11/2002 | Schanzer | |
| D481,473 | S | 10/2003 | Walsh | |
| 7,185,784 | B2 | 3/2007 | Connors, Jr. | |
| 7,273,147 | B2 | 9/2007 | Willat | |
| D601,852 | S | 10/2009 | Newman | |
| D606,368 | S | 12/2009 | Wu | |
| D645,748 | S | 9/2011 | Sharma et al. | |
| 8,567,635 | B2 | 10/2013 | Willat | |
| D693,687 | S | 11/2013 | Karay | |
| 8,573,425 | B1 * | 11/2013 | Park | B65D 11/04 220/295 |
| D699,571 | S | 2/2014 | Zomorodi et al. | |
| 8,684,208 | B2 * | 4/2014 | Hotell | B65D 7/04 215/10 |
| 8,807,340 | B2 | 8/2014 | Zimmer | |
| 9,120,598 | B2 | 9/2015 | Meyers | |
| 9,155,410 | B2 | 10/2015 | Albers | |
| D771,439 | S | 11/2016 | Miller | |
| D774,828 | S | 12/2016 | Miller | |
| D775,957 | S | 1/2017 | Hunt et al. | |
| D784,072 | S | 4/2017 | Baron et al. | |
| 9,648,971 | B2 * | 5/2017 | Albers | A47G 19/23 |
| 2006/0121163 | A1 * | 6/2006 | Holloway | G01N 33/14 426/231 |
| 2006/0249518 | A1 | 11/2006 | Festa | |
| 2010/0147864 | A1 | 6/2010 | Howes | |
| 2010/0308042 | A1 | 12/2010 | Faris | |
| 2011/0132781 | A1 | 6/2011 | Willat | |
| 2011/0303678 | A1 | 12/2011 | Zomorodi et al. | |
| 2012/0091131 | A1 | 4/2012 | Arjomand | |
| 2013/0126527 | A1 * | 5/2013 | Chiu | A47G 21/18 220/212 |
| 2013/0221009 | A1 | 8/2013 | Zimmer | |
| 2014/0069917 | A1 | 3/2014 | Meyers | |
| 2014/0238949 | A1 * | 8/2014 | Patel | B65D 21/0228 215/6 |
| 2014/0353309 | A1 | 12/2014 | Albers | |
| 2016/0058227 | A1 | 3/2016 | Albers | |
| 2016/0100702 | A1 | 4/2016 | Albers | |
| 2016/0332785 | A1 | 11/2016 | Sexton | |

* cited by examiner

STACKABLE DRINKWARE

CROSS-REFERENCE TO RELATED APPLICATIONS

This application is a continuation-in-part of international application no. PCT/US2015/024213, filed Apr. 3, 2015, published as WO/2015/153953 on Oct. 8, 2105, which claims priority to U.S. provisional patent application Ser. No. 61/974,731, filed Apr. 3, 2014 and Ser. No. 61/987,901, filed May 2, 2014, the entire contents of which are incorporated herein by reference.

BACKGROUND OF THE INVENTION

1. Field of the Invention

Embodiments according to the present invention relate generally to fluid vessels, and more particularly to drinking fluid vessels to be held in a human hand.

2. Description of Related Art

Olfactory enhancement greatly affects a liquid's taste and perception of quality. As anyone with a severe cold can attest, without a sense of smell, eating and drinking becomes much less enjoyable. The human tongue can perceive only sweet, sour, salty, bitter and umami. All other perceptions of taste (i.e. cherry, apples, cinnamon, mint, etc.) is a result of nasal or retronasal stimulation. Furthermore, the aromatic intensity level is often directly related to a perception of quality; the higher the intensity of aromas, the greater the perception of taste and quality.

Wine is big business. According to recent statistics, nearly four billion bottles of wine are consumed in the United States every year, and the wine industry is about a $30 billion retail industry. Wine consumption has steadily increased over the past twenty years in the United States, and this trend is predicted to continue for many years to come. Wine consumers are not only growing more savvy, but also are trending towards less pretentious and less conventional situations in which to drink wine. The result is an increases in wine consumption at informal gatherings where glass may not be permitted nor desired, among a consumer base that seek out new wines and wine products, so long as these new products enhance or improve their enjoyment.

Some recent, widely-accepted changes in the wine world include screwcap closures, boxed wine and even wine on tap, a cost effective alternative for businesses selling significant volume, such as sports and concert arenas, and outdoor festivals.

In addition to wine, craft beer is a huge industry. The craft beer market is valued at over $14 billion dollars. As consumers spend more on their beers, they want to be able to appreciate the brewer-intended beverage experience, and get the most out of the increased investment they have made in their beverage. Further, there has been a resurgence of the cocktail culture, including the consumption of spirits (e.g., whiskies, cognac, brandy), and mixed cocktails. As with conventional wine glasses, conventional beer and cocktail glasses include a drawback related to packing and transportation.

While there is reported evidence that alcohol has been consumed for the past eight millennia, or thereabouts, dated by the presence of perceived wine stains on stoneware artifacts, there remains room for improvement in the art of devices used in wine tasting and/or drinking.

In the human sensory examination and evaluation of liquids, particularly alcoholic beverages, one of the well-accepted stages of analysis involves how a liquid performs in the vessel (e.g. cup or glass), from which it is being consumed. This performance may be related to its appearance, smell and taste. A properly designed glass is capable of enhancing all three. While many designs feature a transparent surface with a bulbous cavity having a first diameter and a mouth having a second, smaller diameter that is used to gently focus aromas, the major disadvantage is that such glasses are not readily stackable. While recent advancements in glass technology have eliminated stems from glasses, making them at least partially nestable, there remains a great need for beverage vessels that provide an adequate aromatic concentration effect while at the same time being easily transportable.

In conjunction with stackability, it may be desirable to provide a pre-measured amount of fluid in a portion of such stackable drinkware. While pre-filled (presented to a consumer in a filled, sealed state) beverage containers have been utilized for decades, there remains room for improvement including increased stackability.

SUMMARY OF THE INVENTION

Drinkware according to the present invention combine desirable characteristics of wine glass design for an enhanced vinous experience with the convenience of easy assembly and portability.

Drinkware according to the present invention may be used with any liquid, and preferably any liquid of which the enjoyment of consuming same can be enhanced by way of olfactory stimulation, including, but not limited to wine, beer, spirits and cocktails. The stackable, nestable and easily transportable nature of the present invention ultimately reduces the cost to the end consumer. Currently all other present options with a similar shape cost upwards of two to twenty times more. Additionally, when formed of an injection molding compatible material the present invention may also be a shatterproof drinkware, which is desirable for use in an environment where the use of breakable materials such as glass is not permitted or desired.

This cost-effective and shatterproof option makes it the ideal solution for any event serving large volumes of wine, craft beer, spirits and cocktails, including but not limited to sports and concert arenas, outdoor festivals, restaurants, airlines, airports, hotels, coffee shops, retail wine stores, wine wholesaler events, and end consumer personal situations, such as home parties, where glass is usually not permitted or desired.

Further aspects or embodiments of the present invention will become apparent from the ensuing description which is given by way of example only.

DETAILED DESCRIPTION

Figure 1:
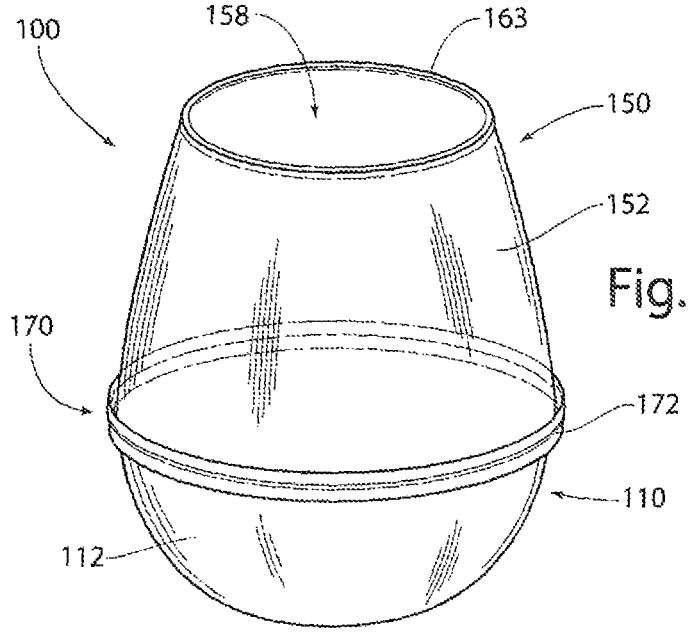
FIG. 1 is a perspective view of a first embodiment of stackable drinkware according to the present invention.

Although the disclosure hereof is detailed and exact to enable those skilled in the art to practice the invention, the physical embodiments herein disclosed merely exemplify the invention which may be embodied in other specific structures. While the preferred embodiment has been described, the details may be changed without departing from the invention.

Turning now to the figures, FIGS. 1-7 depict a first embodiment 100 of stackable drinkware according to the present invention. Generally, the drinkware according to the present invention includes a bottom fluid vessel 110 and a chute 150 attachable, preferably removably attachable, to the vessel 110. When the chute 150 is coupled to the vessel 110, the embodiment 100 preferably has an overall height 102 and defines a fluid cavity 106 having a maximum width 108 measured perpendicular to the height 102. A preferred overall height 102 is about 4.0 inches, and a preferred maximum width 108 is about 2.5 inches to about 4.0 inches, with about 3.0 inches to about 3.5 inches being more preferred.

The vessel 110 generally includes a substantially frusto-spherical sidewall 112 (e.g. having a radius 113 of about 1.5 inches) extending through a vessel height 114 between a closed vessel bottom 116 and an open vessel top 118. The sidewall 112 has a minimum sidewall thickness 112*a*, which is preferably between 0.025 inches and 0.05 inches, with about 0.040 inches being most preferred. A preferred vessel height 114 is about 1.3 inches to about 1.8 inches. The closed vessel bottom 116 may be provided with one or more inwardly extending dimples 120, which may provide structural support to the vessel 110, and such one or more dimples 120 may occupy a majority of the surface area of the closed bottom 116. The vessel 110 may be provided with one or more annular reinforcement ridges 122, which may be integrally formed with the sidewall 112. The reinforcement ridge(s) 122 preferably circumscribe the open vessel top 118, or one or more of the ridges 122 is preferably at least closer to the top 118 than the closed bottom 116.

Figure 5:
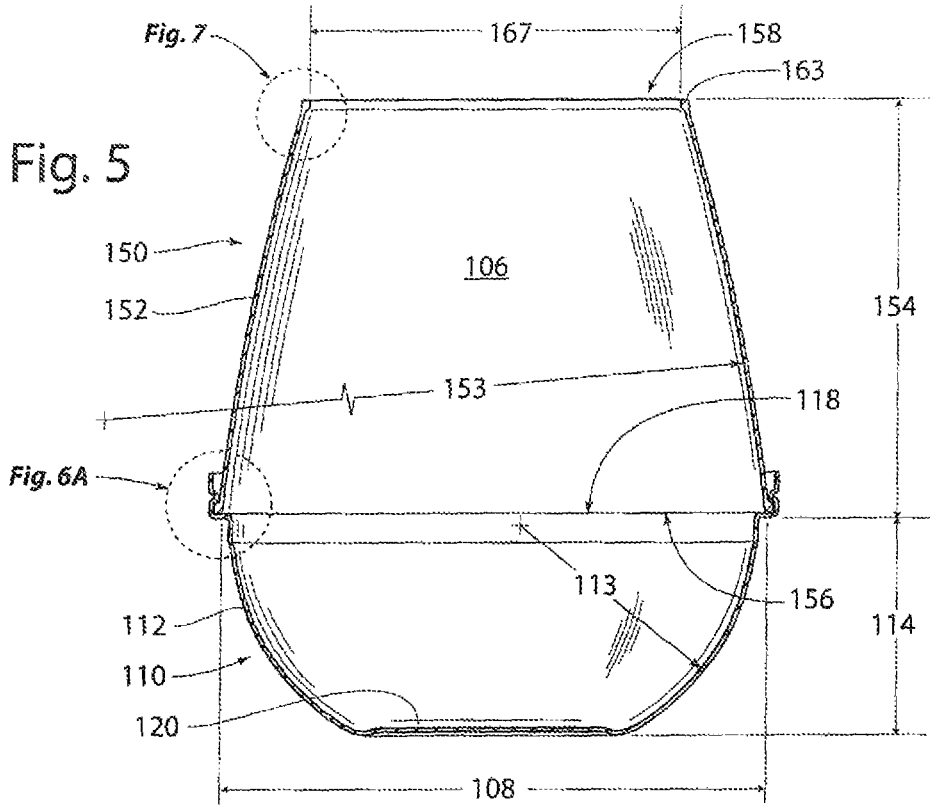
FIG. 5 is a cross-section view taken along line 5-5 of FIG. 3.
Figure 6A:
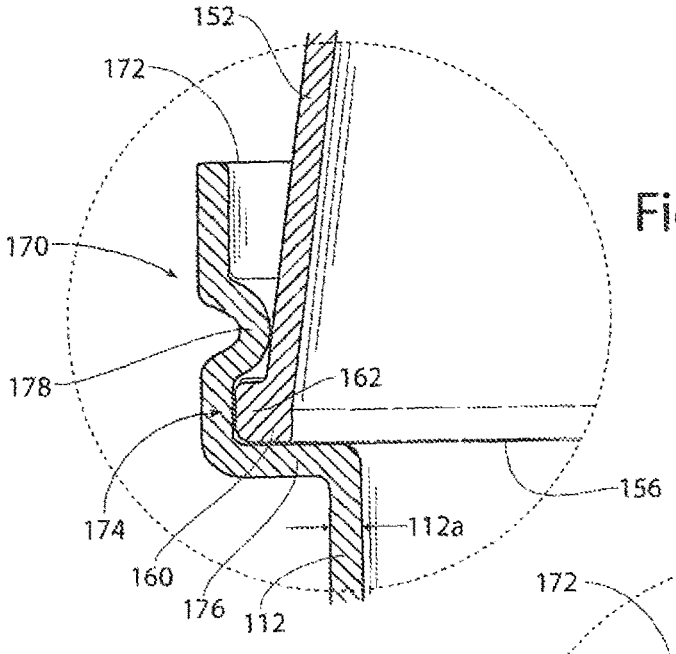
FIG. 6A is a partial cross-section view of the FIG. 6 section called out on FIG. 5.
Figure 7:
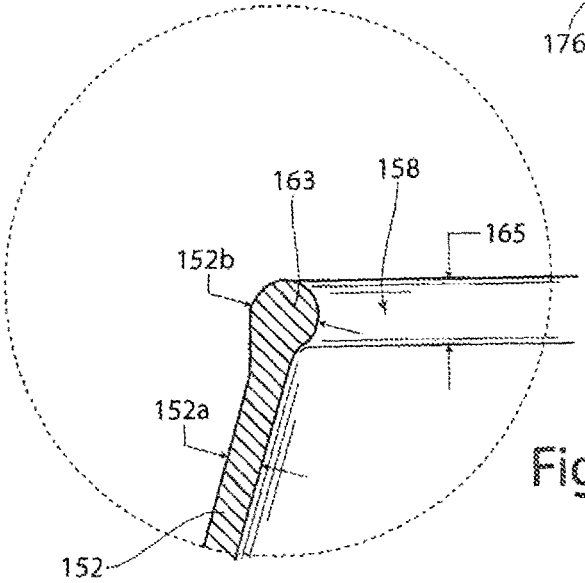
FIG. 7 is a partial cross-section view of the FIG. 7 section called out on FIG. 5.

The chute 150 generally includes a substantially frusto-conical sidewall 152 extending through a chute height 154 between an open chute bottom 156 and an open chute top 158. The sidewall 152 may be completely frustoconical, or its gradual curvature may have a large radius 153, such as about three to four times the height 102 of the embodiment 100, as shown in FIG. 5, where the radius 153 of a hypothetical spheroid having a wall comparable to the curvature of the cross sectional embodiment 100 would be about three to four times the height 102 of the embodiment 100; and, this does not suggest that the radius of the embodiment 100 itself is three to four times the height 102 of the embodiment 100. That is to say, that the curvature of the sidewall 152 will provide an exterior esthetic appearance comparable to a single piece stemless wine glass when embodiment 100 is assembled. The sidewall 152 preferably has a minimum chute sidewall thickness 152*a* (e.g. about 0.040 inches) and a chute mouth sidewall thickness 152*b* (e.g. about 0.060 inches) measured parallel to the minimum thickness 152*a* at the open top 158. As shown in FIG. 6A, the chute bottom 156 preferably includes a circumferential rim 160, which may have a radially extending ridge 162 formed integrally therewith. As seen in FIG. 7, the chute top 158 preferably includes a circumferential rounded edge 163, which has a mouth height 165 (e.g. about 0.060 inches) measured parallel to the embodiment height 102. The edge 163 preferably surrounds or forms a part of the open top chute end 158, the opening having a diameter 167 that is less than the maximum cavity width 108, and more preferably about 60% to about 80%, and most preferably about 68% to about 72%, of the maximum cavity width 108. Alternatively, the chute top 158 may be formed by a portion (not shown) of the sidewall 152 curled inwardly or outwardly backwards towards the chute bottom 156 and/or sidewall 152 to form a generally J-, P-, or hook-shaped cross-section.

The vessel 110 and chute 150 may be linked at a coupling 170, including mating portions on each. In the first embodiment 100, the coupling 170 includes a coupling collar 172 extending from the open top 118 of the vessel 110 and the rim 160 provided about the bottom 156 of the chute 150. The collar 172 includes an annular receiving groove 174 defined between an annular receiving ledge 176 extending outward from the vessel wall 112 and an annular retaining ridge 178. When assembled, the circumferential ridge 162 on the chute 150 is trapped in the receiving groove 174, between the ledge 176 and retaining ridge 178. The frictional contact between the ridge 162 (or rim 160) and the groove 174, ledge 176, and/or ridge 178 is sufficient to maintain a seal to prevent leakage of a liquid (e.g. a beverage such as water or wine) out of the cavity 106 through the coupling 170. Additionally or alternatively, a gasket material (not shown) may be disposed between the vessel 110 and the chute 150 at the coupling 170 to assist in the seal.

Figure 6B:
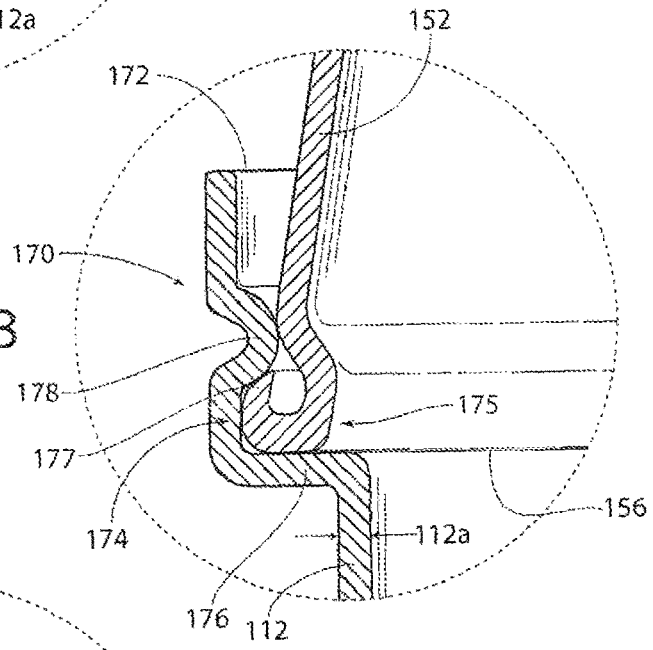
FIG. 6B is an alternate partial cross-section view of the FIG. 6 section called out on FIG. 5.

An alternate cross-section of the chute bottom 156 is shown in FIG. 6B. In this embodiment of the bottom 156, rather than provide a rim 160 and ridge 162 as in the previous description, the end 156 may be provided with a circumferential outward roll 175 or other structure providing a generally J-shaped cross-section as shown. In this arrangement, a plurality of sealing contact points may be provided between the chute 150 and vessel 110. The roll 175 preferably includes an outwardly biased free clip end 177 adapted to cooperate with the ridge 178 to maintain the vessel 110 and chute 150 in an assembled relationship. The roll 175 preferably nests substantially within the receiving groove 174 and the frictional contact between the roll 175 (and/or clip end 177 thereof) and the groove 174, ledge 176, and/or ridge 178 is sufficient to maintain a seal to prevent leakage of a liquid (e.g. a beverage such as water or wine) out of the cavity 106 through the coupling 170. Additionally or alternatively, a gasket material (not shown) may be disposed between the vessel 110 and the chute 150 at the coupling 170 to assist in the seal.

The coupling 170 is preferably provided circumjacent the maximum cavity width 108 to enhance stackability. This maximum width 108 is preferably provided at or near the open top 118 of the vessel 110. In any event, the coupling 170 and/or maximum width 108 is preferably provided at a predetermined location along the height 102 of the embodiment 100, such as about 25% to about 50% of the height 102 as measured from the closed vessel bottom 116. For example, on an embodiment 100 having a height 102 of about four inches preferably includes a coupling 170 having at least a portion located between about an inch from the bottom 116 and about two inches from the bottom.

Figure 8:
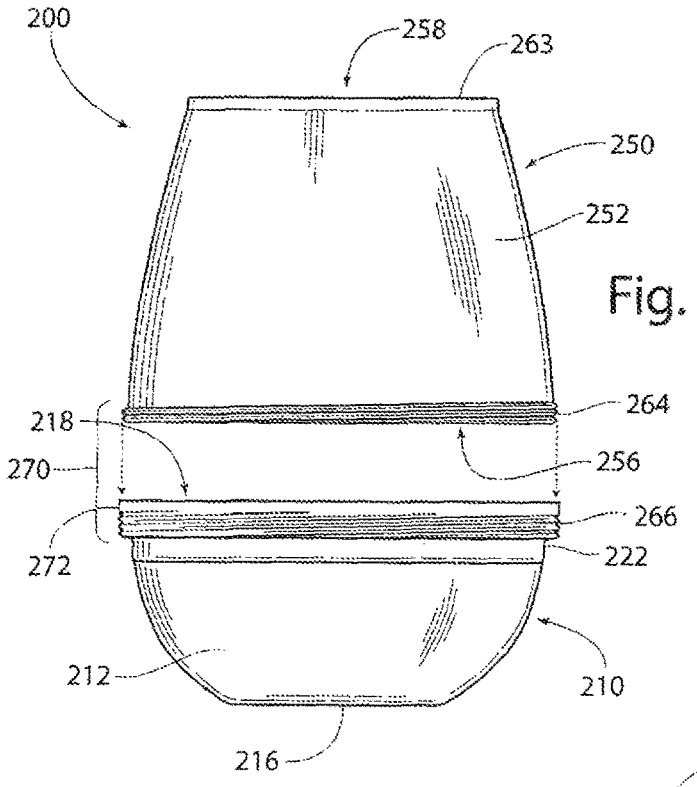
FIG. 8 is a front side assembly view of a second embodiment of stackable drinkware according to the present invention.

FIG. 8 depicts a second embodiment 200 of stackable drinkware, where similar reference numerals refer to similar or identical structure as compared to the first embodiment 100. In this embodiment, a more intricate coupling 270 is provided in the manner of mating threads on the vessel 210 and the chute 250. That is, one or more circumferentially ramped threads 264 (male or female) may be provided on the chute 250, extending preferably from the open chute bottom end 256 towards the top end 258. The threads 264 may be formed into the chute sidewall 252 or disposed thereon. The mating threads 266 include one or more circumferentially ramped threads 266 (female or male) provided on the vessel 210, extending preferably within the coupling collar 272, but could also be located on the exterior of the coupling collar. The frictional contact between the threads 266,266 is sufficient to maintain a seal to prevent leakage of a liquid (e.g. a beverage such as water or wine) out of the cavity 206 through the coupling 270. Additionally or alternatively, a gasket material (not shown) may be disposed between the vessel 210 and the chute 250 at the coupling 270 to assist in the seal.

Figure 9:
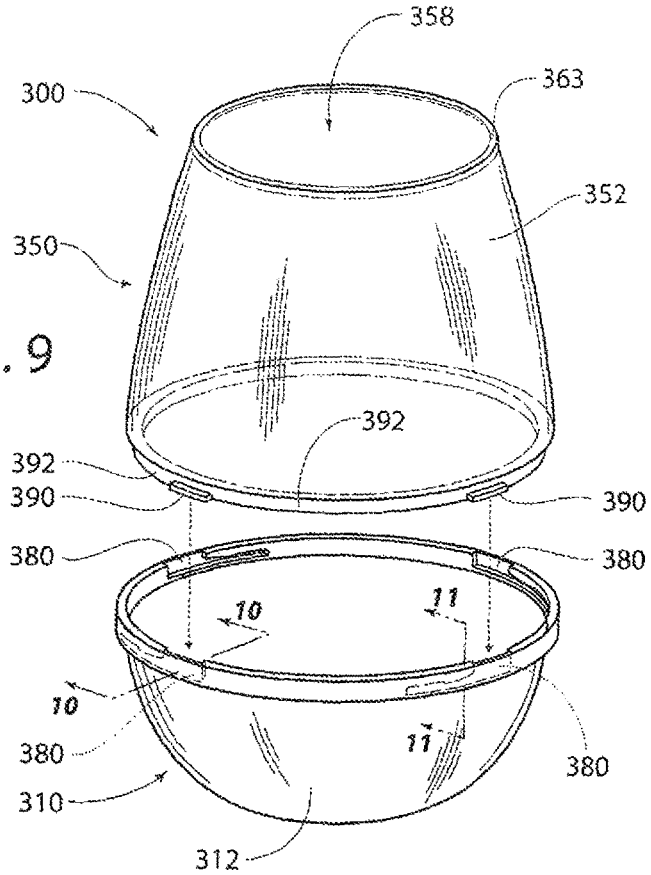
FIG. 9 is a perspective assembly view of a third embodiment of stackable drinkware according to the present invention.
Figure 10:
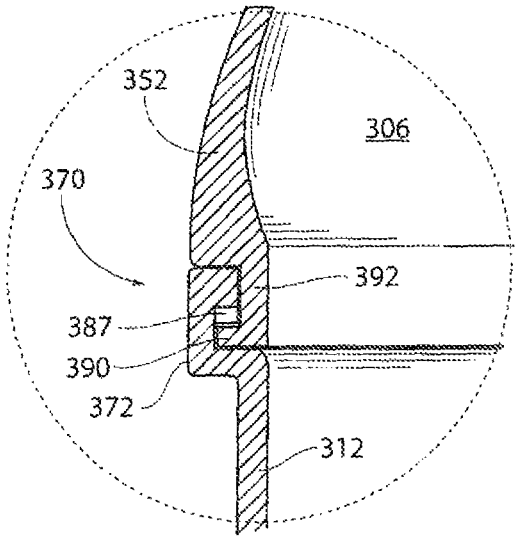
FIG. 10 is a partial cross-section view taken along line 10-10 of FIG. 9 after the embodiment is assembled.
Figure 11:
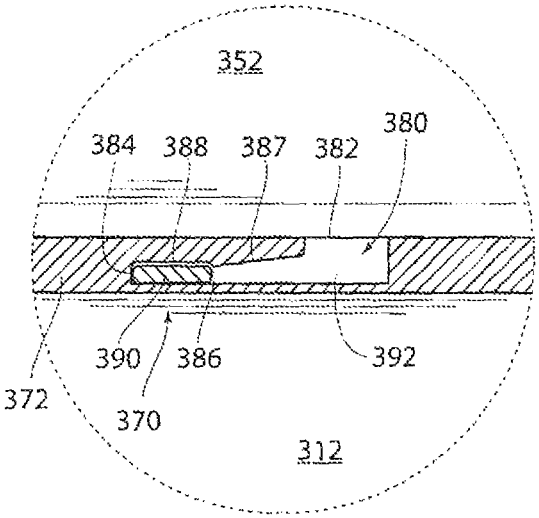
FIG. 11 is a partial cross-section view taken along line 11-11 of FIG. 9 after the embodiment is assembled.

FIGS. 9-11 show a third embodiment 300 of stackable drinkware according to the present invention, where similar reference numerals refer to similar or identical structure as compared to the first embodiment 100. Like the second embodiment 200, this embodiment 300 includes a more intricate coupling 370 in the nature of a locking tab and slot arrangement. A coupling collar 372 extends from the vessel sidewall 312. Formed into the collar 372 is a plurality of slots 380 preferably formed at locations symmetrically spaced about the circumference of the collar 372. Each slot 380 extends from an open first end 382 to a closed second end 384, the slot 380 preferably at least partially becoming narrower at some point 386 (such as by way of a ramp 387 formed therein) between the first end 382 and the second end 384. The slot 380 may include a tab relief 388 disposed between the narrowest point 386 along the slot 380 and the terminal end 384. A plurality of tabs 390 may be provided on the chute 350, preferably corresponding to the number and location of the plurality of slots 380 on the vessel 310. The tabs 390 preferably extend radially outward from a tab collar 392, which is circumferentially disposed about the open chute bottom end 358 and recessed from an outer surface of the chute sidewall 352. Alternatively, the tabs 390 may depend directly from the chute sidewall 352, without the use of a circumferential recessed collar 392, at discrete locations corresponding to the locations of the slots 380 on the vessel 310. In this manner, when the vessel 310 and chute 350 are assembled, preferably each slot 380 receives a tab 390, which may be held frictionally therein. Accordingly, the interface between the collar 372 and the tabs 390 and/or collar 392 provides a seal sufficient to prevent leakage of a liquid (e.g. a beverage such as water or wine) out of the cavity 306 through the coupling 370. Additionally or alternatively, a gasket material (not shown) may be disposed between the vessel 310 and the chute 350 at the coupling 370 to assist in the seal.

Figure 12:
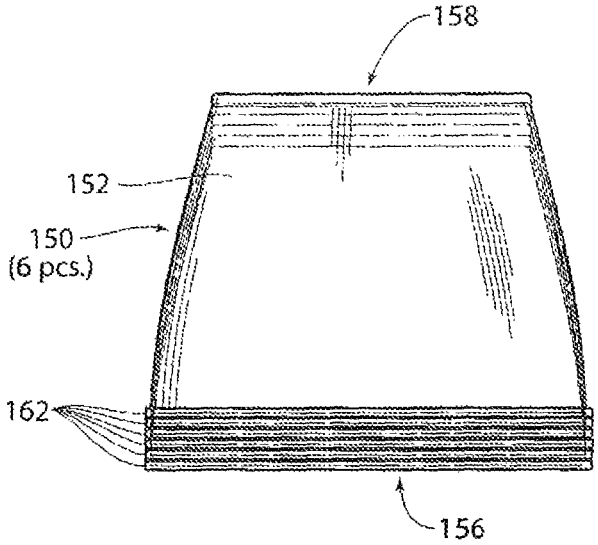
FIG. 12 is a front side elevation view of a plurality of drinkware top portions nested together.
Figure 13A:
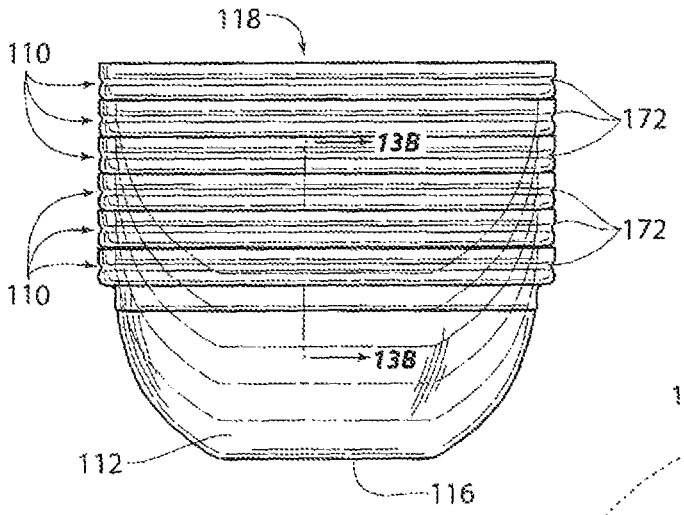
FIG. 13A is a front side elevation view of a plurality of drinkware bottom portions nested together.
Figure 13B:
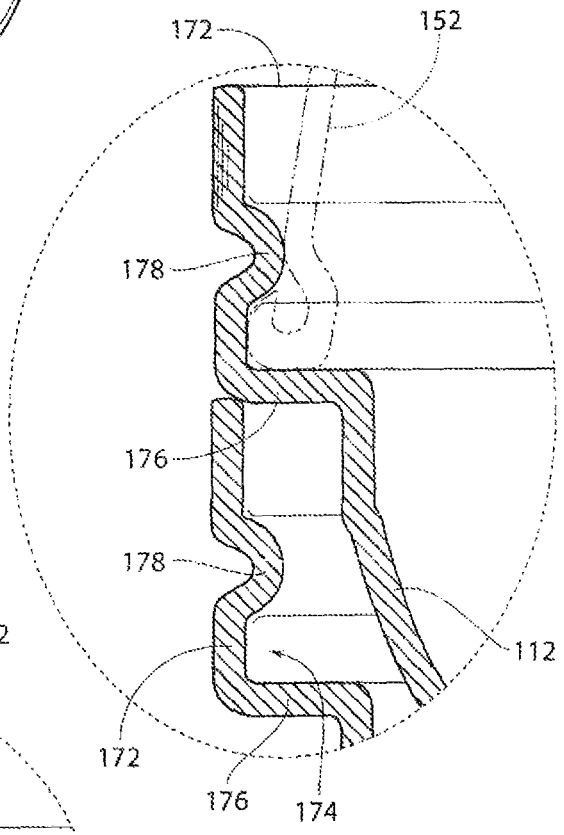
FIG. 13B is a partial cross-section view taken along line 13B-13B on FIG. 13A.
Figure 13C:
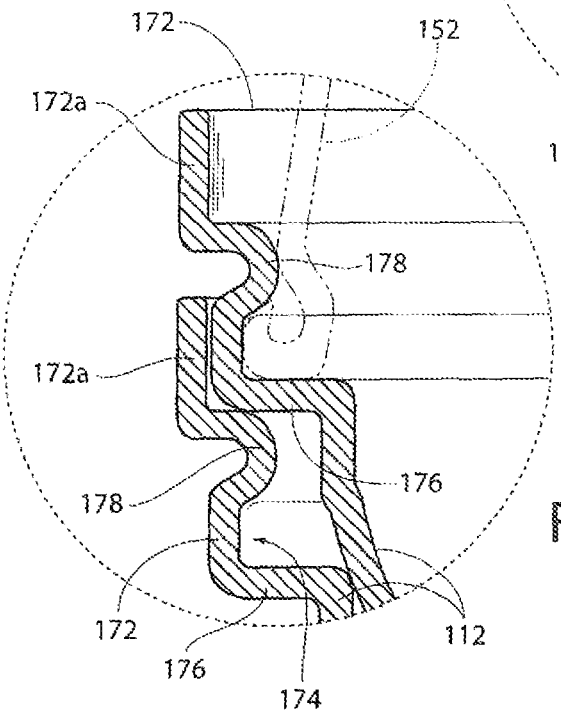
FIG. 13C is an alternate partial cross-section view taken along line 13B-13B on FIG. 13A.

FIGS. 12-13C demonstrate the stackability of the components 110,150 according to the first embodiment 100. Preferably, drinkware components according to the present invention have a desirable stacking factor. A stacking factor, as used herein, is equal to the number of components that may be nested within a space defined by a component footprint area multiplied by twice the height of the component. For instance, with respect to the first embodiment 100, the stacking factor of the chute 150 (FIG. 12) is preferably about 20 to about 50, with about 40 to 45 being most preferred, whereas the stacking factor of the vessel 110 (FIGS. 13A-C) is preferably about four to about ten. For example, presuming a chute 150 having an outside diameter at the chute bottom 156 of about 3.62 inches and a chute height 154 of about 2.63 inches, it is preferable to be able to nest 20 to 50 chutes 150 in a space defined by the footprint of the bottom end 156 of the chute 150 and extending for a length of twice the height 154, or about 5.26 inches. As shown in FIGS. 13B and 13C, when two vessels 110 are nested, the coupling collars 172 may be stacked (FIG. 13B) or at least partially nested (FIG. 13C). If nesting of the collars 172 is desirable, the collar 172 may be provided with the receiving groove 174 and ridge 178, as described above, but extending from the ridge 178 may be an expanded collar portion 172*a*, adapted to receive an annular receiving ledge 176 of a nested vessel 110. In this manner, the annular ledge 176 of a first vessel 110 may rest against the ridge 178 of a second vessel 110, which may improve the stacking factor of the vessel 110, alone, by as much as 40% or more. The stacking factor will vary among the different embodiments of this invention, but minimally the stacking factor will be at least 4 for all embodiments of this invention.

Figure 14:
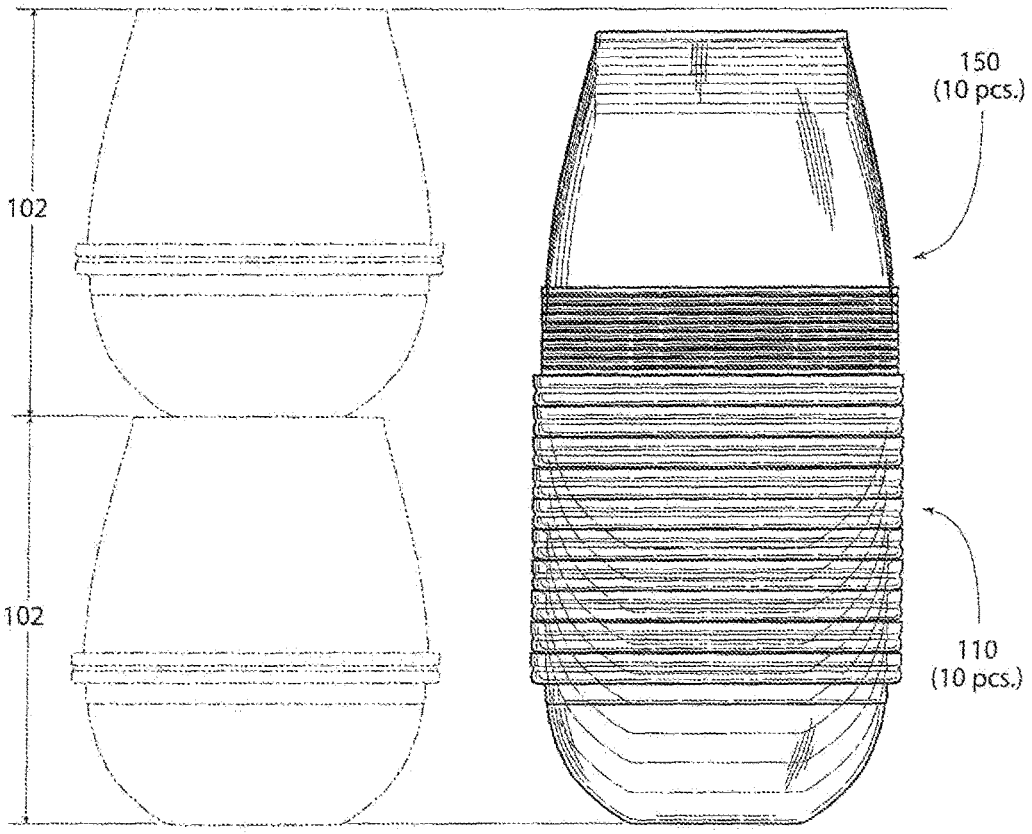
FIG. 14 is a front side elevation view of a plurality of stacked components to form complete embodiments of drinkware according to the present invention.
Figure 15:
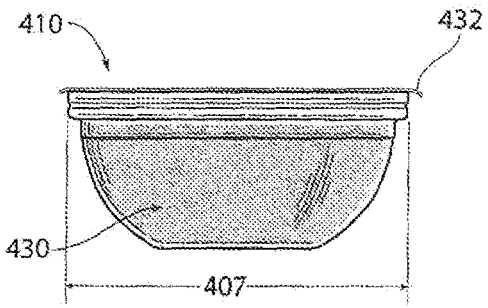
FIG. 15 is a front side elevation view of a fourth embodiment of a vessel according to the present invention.

The complete embodiment 100 preferably includes a stacking factor of about five to twenty with at least ten being preferred. That is, in a space defined by the footprint of the widest width 107 of the embodiment 100, and extending for a length of twice the complete height 102 of the embodiment 100, preferably at least ten of the vessels 110 and at least ten of the chutes 150 may be disposed, as shown in FIG. 14. If nested coupling collars 172 are utilized, this stacking factor may be increased to at least fifteen, and more preferably at least sixteen.

Drinkware embodiments according to the present invention may be made from any materials that will maintain an acceptable fluid containing seal at the coupling 170. Additionally, for the pre-filled embodiment 400 discussed below, materials may be selected with an eye towards shelf-life, permeability, and/or prevention of discoloration. For instance, where a snap frictional compression coupling (e.g. 170) is desired, preferable materials for one or both the vessel 110 and chute 150 may include polypropylene, polyester, polylactide (PLA), polyethylene terephthalate (PET), and/or polystyrene. Where a more intricate coupling (e.g. 270, 370), such as a progressive frictional compression with threads or tabs, materials such as polystyrene, copolyester, high density polyethylene, polyethylene terephthalate (PET), and/or low density polyethylene may be desirable.

Methods to manufacture drinkware according to the present invention include injection molding, blow molding, thermoforming (including vacuum forming), and rotational molding, with injection molding being a preferred methodology.

Figure 16:
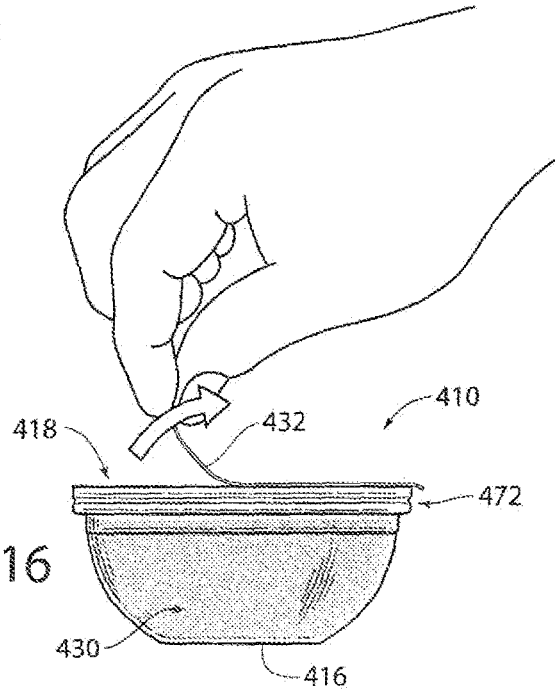
FIG. 16 is a front side elevation view of an opening step of a method according to the present invention.
Figure 17:
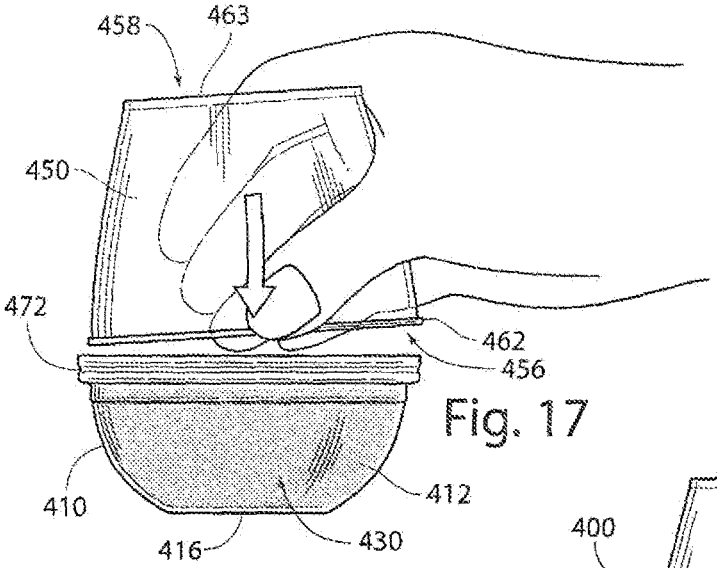
FIG. 17 is a front side elevation view of a coupling step of a method according to the present invention.
Figure 18:
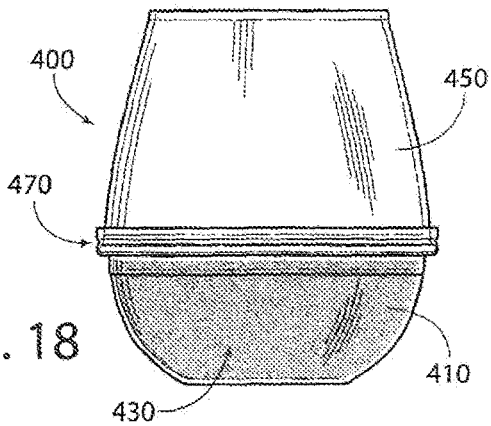
FIG. 18 is a front side elevation view of an assembled fourth embodiment of drinkware according to the present invention.

FIGS. 15-18 depict an alternative embodiment 400, where similar reference numerals refer to similar or identical structure as compared to the first embodiment 100. This embodiment 400 includes a vessel 410, which is provided to a consumer filled with a fluid 430 (e.g. wine) and sealed with a removable film or foil 432. Thus, the vessel 410 is filled with a fluid 430 prior to final coupling of the chute 450 to the vessel 410 prior to use. The fluid 430 may be packaged in the vessel 410 under vacuum (vacuum sealed) in an attempt to limit or reduce the amount of oxygen in the sealed vessel. In a first providing step, a sealed vessel 410 is provided. The seal 432 is preferably provided about the perimeter of the open top 418 of the vessel 410. The seal 432 may be adhered to the vessel 410 on the coupling collar 472, or the circumferential ridge 462, either of which cooperating structure may be provided on the vessel 410. The seal 432 may span the entire width 407 of the vessel 410, but at least completely covers any opening 418 formed in the top of the vessel 410. In an opening step, the seal 432 is removed, at least partially, as shown in FIG. 16, and preferably completely, thereby allowing fluid communication between the interior of the vessel 410 and the ambient environment. Preferably after the seal 432 has been at least partially disconnected from the vessel 410, the chute 450 may be coupled thereto in a coupling step, as shown in FIG. 17 and as previously described. Thus, the fully assembled drinkware 400 may be provided with a pre-measured amount of fluid 430, such as preferably between one fluid ounce and seven fluid ounces, with 6.3 ounces being most preferred. The seal 432 is preferably formed from a flexible film, such as NYLON, ethylene vinyl alcohol (EVOH), linear low-density polyethylene (LLDPE), low-density polyethylene (LDPE), polyethylene terephthalate (PET), or polypropylene (PP). The film 432 may be secured to the vessel 410 by any suitable means, such as by an adhesive, and/or by thermobonding, such as ultrasonic or heated pressure bonding. Regardless of the bond, it is preferable to avoid placing the bond on a majority of the frictionally interacting surface areas of the coupling 470.

The stacking factor of the chute 450 of this embodiment 400 is preferably the same as or substantially similar to that of the chute 150 of the first embodiment, that is, about 20 to about 50, with about 40 to 45 being most preferred. The stacking factor of the vessel 410 of this embodiment is about 2. The stacking factor of the entire embodiment 400 is at least three, and preferably about 3.5 to about 4, with about 3.75 to about 3.85 being most preferred. Preferably, three sealed vessels 410 may be stacked on top of each other and at least three nested chutes 450, and more preferably three vessels 410 and at least ten nested chutes 450, would fit in a space defined by a the footprint area of the embodiment 400 area multiplied by twice the height of the embodiment 400 when assembled.

Figure 19:
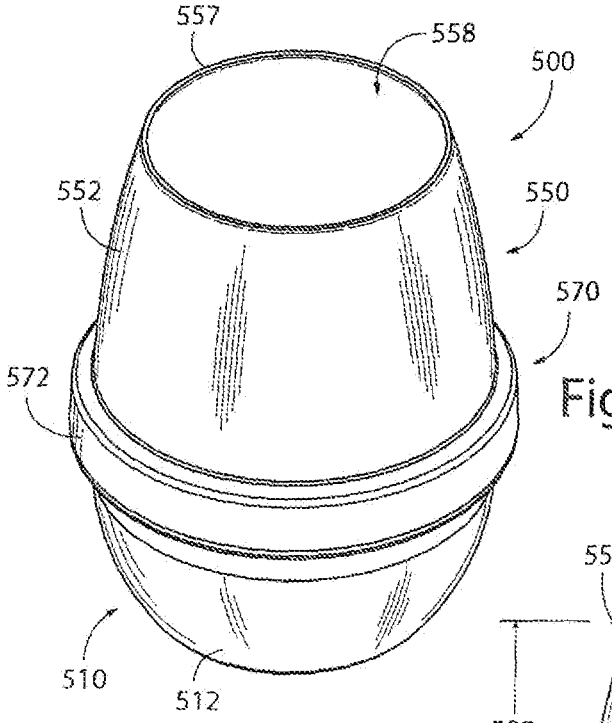
FIG. 19 is a perspective view of a fifth embodiment of stackable drinkware according to the present invention.

Turning now to FIGS. 19-29 and initially FIG. 19 a fifth embodiment 500 of stackable drinkware, i.e. a beverage receptacle such as a wine glass, is illustrated, where similar reference numerals refer to similar or identical structure as compared to the first embodiment 100. Generally, the drinkware or beverage receptacle according to the fifth embodiment of the present invention includes a bowl 510, also identified as a bottom fluid vessel in the proceeding embodiments, and a tube 550, which is also identified as a chute in the proceeding embodiments, that is attachable, and preferably removably attachable, to the bowl 510. When the tube 550 is coupled to the bowl 510, the beverage receptacle embodiment 500 preferably has an overall height 502 and defines a fluid reservoir or capacity 506 having a maximum width 508 measured perpendicular to the height 502. A preferred overall height 502 is about 4.2 inches, and a preferred maximum width 508 is about 3.0 inches to about four inches, with about 3.25 inches to about 3.75 inches being more preferred.

Figure 23:
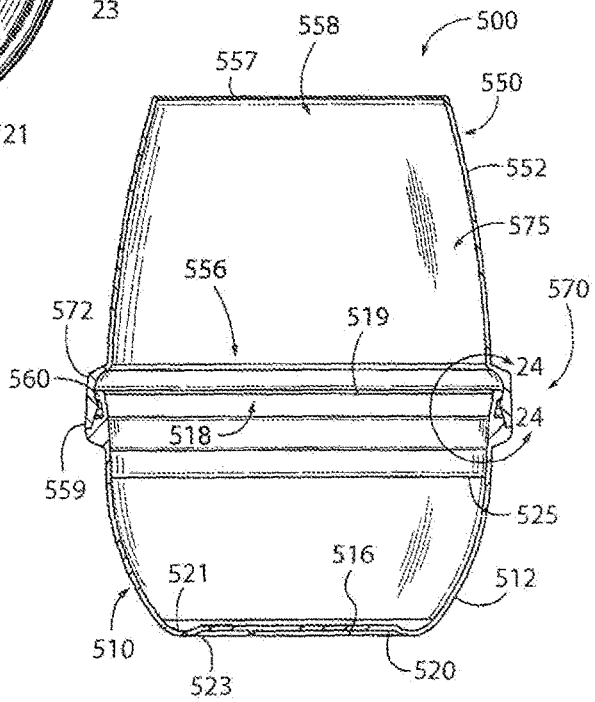
FIG. 23 is a cross-section view taken along line A-A of FIG. 22.
Figure 24:
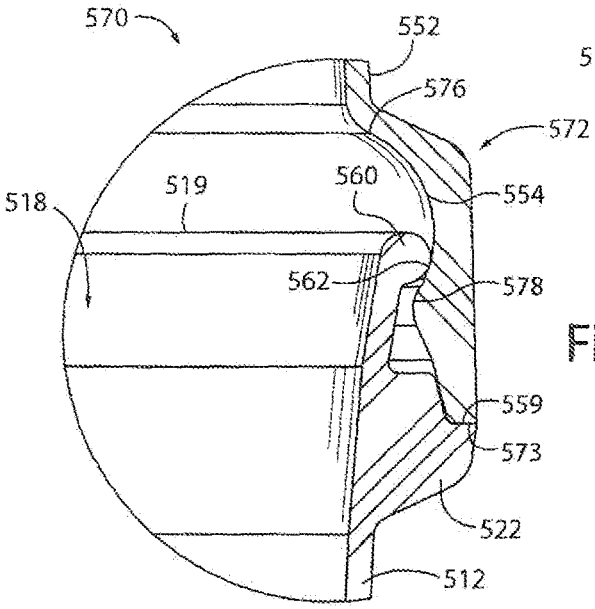
FIG. 24 is a partial cross-section view of the FIG. 24 section called out on FIG. 23.

The bowl 510 generally includes a curved sidewall 512 that is inwardly concave relative to the central longitude axis of the embodiment 500. The curved sidewall 512 of the bowl 520 extending through the bowl height 514 between an open top 518 of the bowl 510 at a first edge 519 of the sidewall 512 and the closed bowl bottom surface 516 at a second edge 521 of the sidewall 512. The open top 518 of the bowl 510, defined by the first edge 519 has an interior width 527, which is preferably between 2.8 inches and 3.5 inches, with about 3.1 inches being most preferred. The closed bottom surface 516 of the bowl 510, defined by the second edge 521 has an interior width 529, which is preferably between 1.5 inches and 2.5 inches, with about 1.75 inches being most preferred. The sidewall 512 has a minimum sidewall thickness 512*a*, which is preferably between 0.01 inches and 0.06 inches, with about 0.04 millimeters being most preferred. A preferred bowl height 514 is about 1.75 inches to about 2.25 inches. The closed bowl bottom surface 516 may be defined within an outer circumferential edge 523 that is connected, integral with or otherwise connected to the second edge 521 of the sidewall 512. The closed bowl bottom surface 516 may also be provided with one or more inwardly extending dimples 520, which may provide structural support to the bowl 510, and such one or more dimples 520 may occupy a majority of the exterior side or surface area of the closed bottom surface 516. The bowl 510 may be provided with one or more annular ridges 522, which may be integrally formed with the exterior side of the sidewall 512 and extend outwardly therefrom. The annular ridge(s) 522 preferably circumscribe the open bowl top 518, slightly offset from but adjacent the first edge 519. That is to say that the one or more of ridges 522 is positioned along the exterior side of the sidewall 512 near the first edge 519, and is preferably at least closer to the top 518 of the bowl 510 than the closed bottom surface 516, as shown in FIGS. 20-24. One or more indicia 525 may be located at positions about the height 514 of the sidewall 512 of the bowl 510, wherein the indicia 525 indicate a predetermined fluid volume within the fluid reservoir. For example, the indicia 525 may indicate a given number of fluid ounces to assist in filling the fluid reservoir with a corresponding volume of fluid. In an alternative embodiment, the indicia 525 may be alternatively or additionally located at positions about the sidewall 552 of the tube 550 or on the coupling collar 572 of the tube 550, described in detail below. As shown in FIG. 24, the bowl top 518 preferably includes a circumferential rim 560, which may have a radially extending ridge 562 formed integrally therewith. Alternatively, the open top 518 may be formed by a portion (not shown) of the sidewall 512 curled inwardly, generally towards the interior surface of the sidewall 512 or outwardly, generally towards exterior surface of the sidewall 512 (or towards the second edge 559 that defines the open tube bottom 556 of the tube when embodiment 500 is assembled) to form a generally J-, P- or hook-shaped cross-section.

The tube 550 generally includes a curved sidewall 552 that is inwardly concave relative to the central longitude axis of the embodiment 500. The curved sidewall 552 extends generally along a tube height 554 between a first edge 557 that defines an open tube top 558 and a second edge 559 that defined an open tube bottom 556. The height 554 of the tube 550 is preferably between 1.5 inches and 3.25 inches, with about 2.75 inches being most preferred. The first edge 557 of side wall 552 of the tube 550 defines an open top 558, i.e. the opening at the top of the beverage receptacle of embodiment 500, which has an area that is less than an area of the open bottom 556 that is defined by the second edge 559 of side wall 552 of the tube 550. The open top 558 of the tube 550, defined by the first edge 557 has an interior width 561, which is preferably between 2.0 inches and 3.0 inches, with about 2.5 inches being most preferred. The open bottom 556 of the tube 550, defined by the second edge 559 has an interior width 563, which is preferably between 3.0 inches and 4.0 inches, with about 3.3 inches being most preferred. In one alternative embodiment, sidewall 552 may be frustoconical, or it may have a large radius, such as about three to four times the height 502 of the embodiment 500, as described in prior embodiments. The sidewall 552 preferably has a minimum tube sidewall thickness 552*a*, which is preferably between 0.03 inches and 0.06 inches, with about 0.04 inches being most preferred. As shown in FIG. 24, and will be discussed in further detail below, the tube bottom 556, defined by the second edge 559, preferably includes a radially circumferential coupling collar 572 radially extending from the bottom 556 of the tube 550. While not illustrated, the first edge 557 defining the tube top 558 may be rounded, in a manner consistent with the circumferential rounded edge 163 of the first embodiment 100. Alternatively, the first edge 557 located about the tube top 558 may be substantially flush relative to the tube sidewall 552 as shown in FIG. 23. The edge 557 preferably surrounds or forms a part of the open top 558 of the tube 550, the opening having a diameter defined by the width 561, that is less than the maximum cavity width 508, and more preferably about 60% to about 80%, and most preferably about 68% to about 72%, of the maximum cavity width 508. Alternatively, the open top 558 may be formed by a portion (not shown) of the sidewall 552 curled inwardly or outwardly backwards towards the chute bottom 556 and/or sidewall 552 to form a generally J-, P-, or hook-shaped cross-section. In one embodiment of the present invention, the edge 557 of the sidewall 552 is configured to receive a removable lid. The lid may be configured to cover the entire open top 558 of the tube 550 as to prevent fluid from exiting the beverage receptacle of embodiment 500. Alternatively, the lid may be configured to cover a portion of the open top 558 of the tube 550, thereby allowing a straw to be inserted through the lid, or allow a portion of fluid to exit the beverage receptacle of embodiment 500 through a spout or aperture having an area smaller than the area of the open top 558 of the tube 550.

Figure 2:
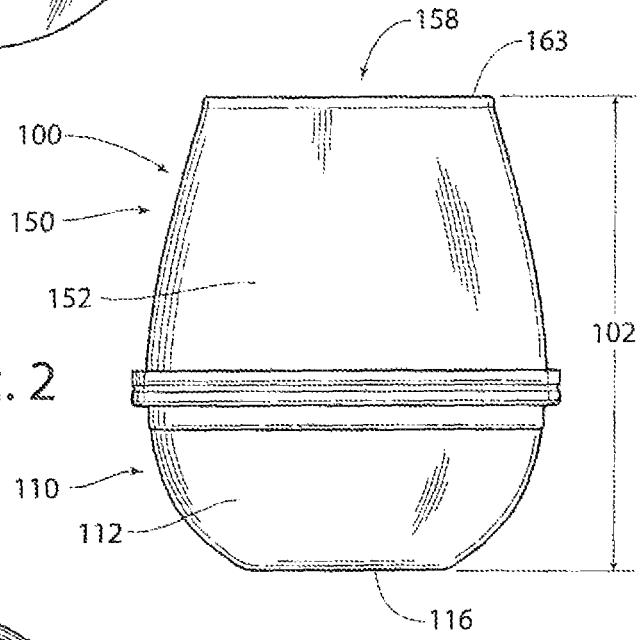
FIG. 2 is a front side elevation view of the embodiment of FIG. 1, to which all side elevation views are identical.
Figure 3:
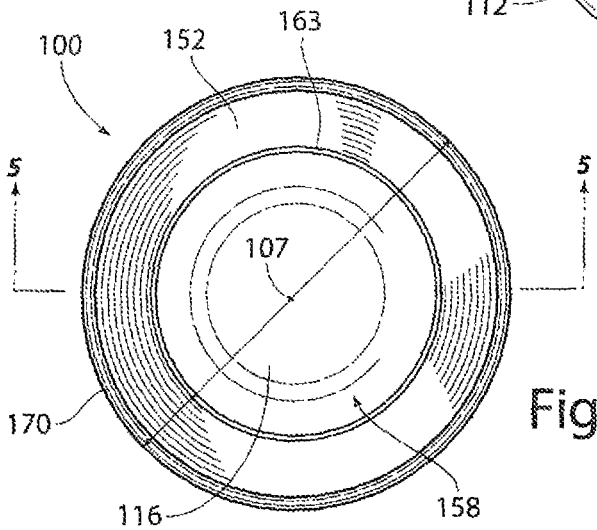
FIG. 3 is a top plan view of the embodiment of FIG. 1.
Figure 4:
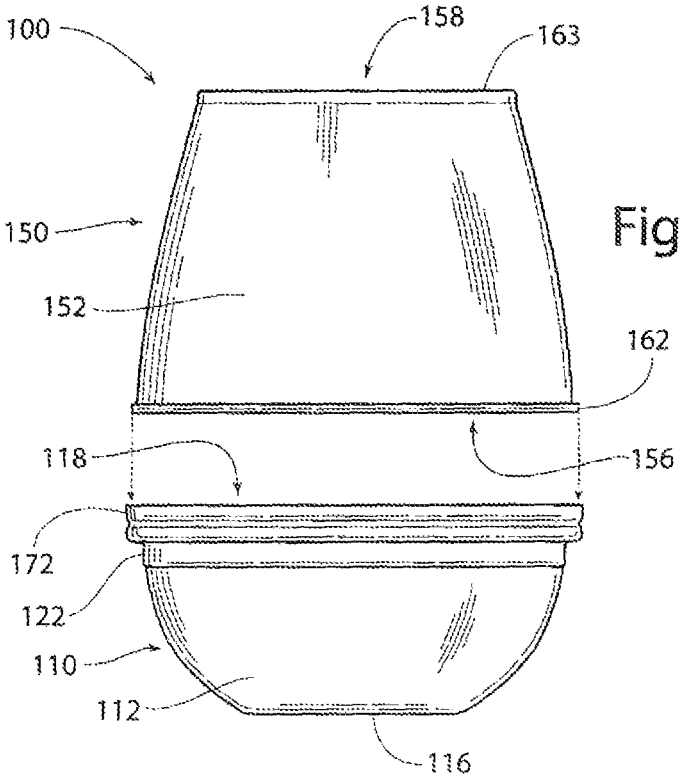
FIG. 4 is a front side assembly view of the embodiment of FIG. 1.

The bowl 510 and tube 550 may be linked at a coupling 570, including mating portions disposed on the bowl 510 and tube 550, respectively. Generally, the relative location of the components of the coupling 570, namely the collar 572 and rim 560, are reversed relative to the first embodiment 100, in which the coupling collar 172 extends from the vessel 110 and the rim 160 is provided about the bottom 156 of the chute 150. That is to say, in the fifth embodiment 500, the coupling 570 includes a coupling collar 572 located at or extending near the bottom 556 of the tube 550 and the rim 560 provided about the open top 518 of the bowl 510. The rim 560 is configured to be received within the collar 572. The collar 572 includes an annular receiving groove 574 defined between an annular receiving protrusion 576 extending outward from the tube sidewall 552 and an annular retaining ridge 578. The annular receiving groove 574 has an interior surface with a circumference that is greater than the circumference of the interior surface of both the annular receiving protrusion 576 and the annular retaining ridge 578. When assembled, the outer or exterior surface of the radially extending ridge 562 of the circumferential rim 560 on the bowl 510 is trapped in the receiving groove 574, between the annular receiving protrusion 576 and retaining ridge 578, as shown in FIG. 2. When assembling the beverage receptacle of embodiment 500, the rim 560, or the radially extending ridge 562 thereof, which has an outer circumference larger than the interior circumference of the annular ridge 578, is configured to inwardly deflect about the annular ridge 578, while the bowl 510 and tube 550 are pressed together. After the rim 560 has traveled past the location of the annular ridge 578, the rim 560 expands outwardly to engage the interior surface of the receiving groove 574. In one embodiment, the outer circumference of the rim 560 is equal to or greater than the inner circumference of the receiving groove 574, as to maintain a frictional engagement between the rim 560 and the receiving groove 574.

When assembled, engagement of the rim 560 against the receiving groove 574 forms a snap-fit closure at the coupling 570, and preferably a fluid tight seal. That is to say that the frictional contact between the rim 560 and the groove 574, when assembled, is sufficient to maintain a seal to prevent leakage of a liquid or fluid (e.g. a beverage such as water or wine) out of the cavity 506 through the coupling 570. Once the bowl 510 and tube 550 have been connected together via engagement of the rim 560 and collar 572, a fluid reservoir 575 is formed within the beverage receptacle embodiment 500, defined by the interior side of the bottom surface 516, the interior side of the sidewall 512 of the bowl 510 and the interior side of the curved sidewall 552 of the tube 550. Additionally or alternatively, a gasket material (not shown) may be disposed between the bowl 510 and the tube 550 at the coupling 570 to assist in the seal.

Figure 20:
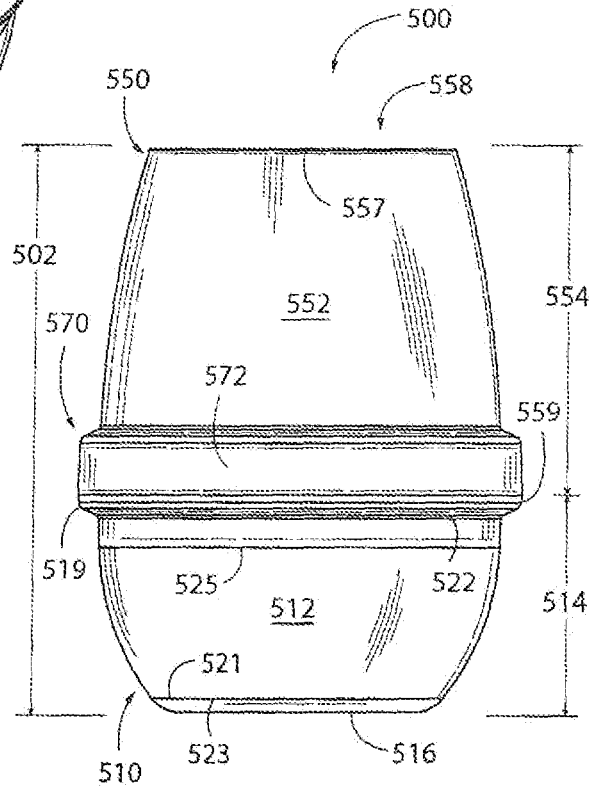
FIG. 20 is a front side elevation view of the embodiment of FIG. 19, to which all side elevation views are identical.
Figure 21:
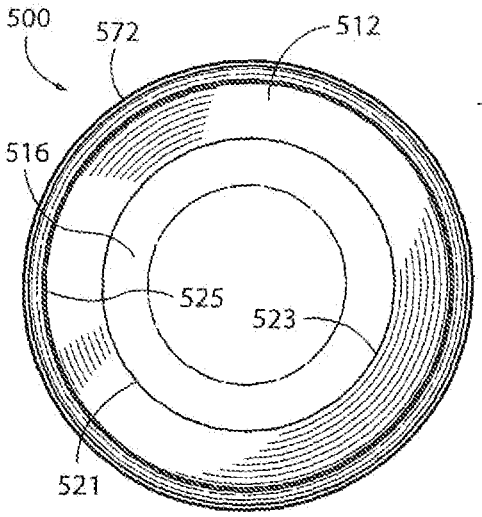
FIG. 21 is a bottom plan view of the embodiment of FIG. 19.
Figure 22:
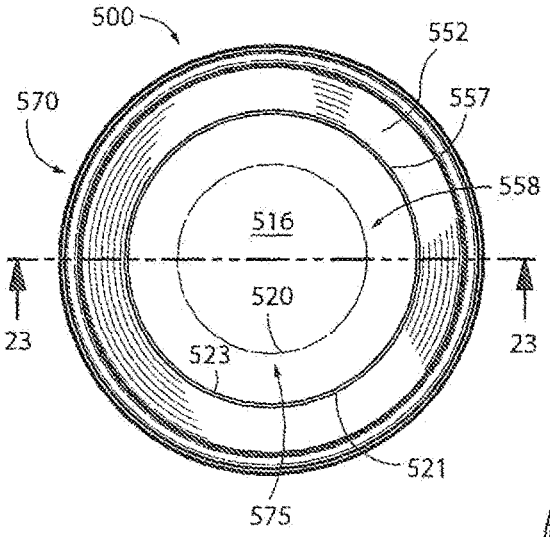
FIG. 22 is a top plan view of the embodiment of FIG. 19.
Figure 25:
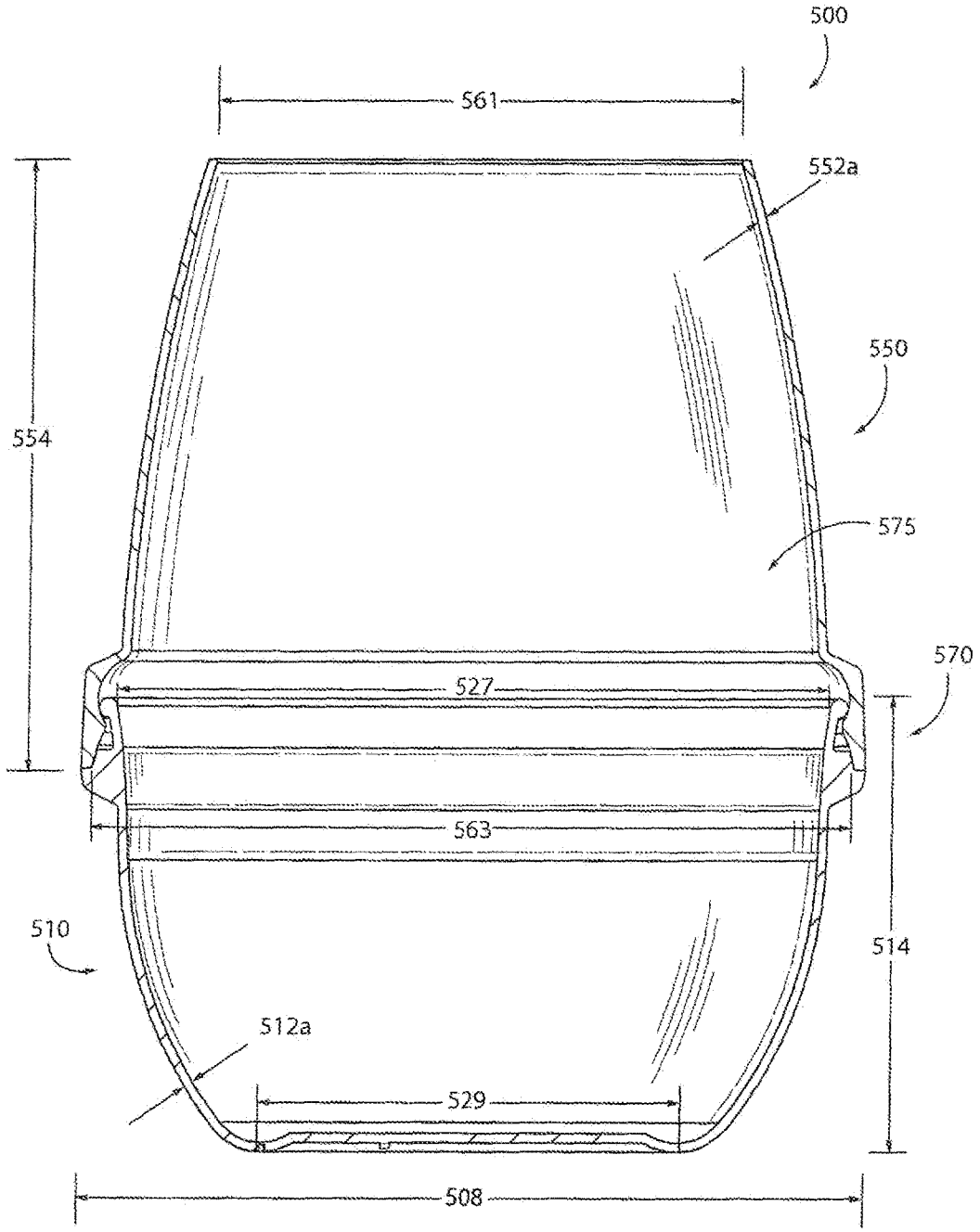
FIG. 25 is a cross-section view taken along line A-A of FIG. 22.
Figure 26:
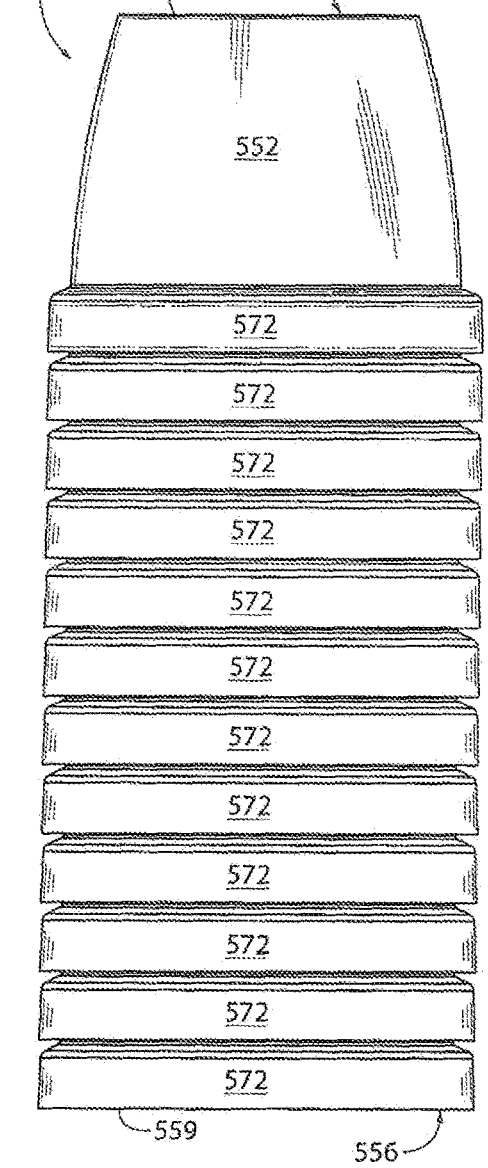
FIG. 26 is a front side elevation view of a plurality of drinkware tube portions nested together, according the fifth embodiment of stackable drinkware of the present invention.

Furthermore, as shown in FIGS. 20, 23 and 25, when assembled as described above, the resultant beverage receptacle of embodiment 500 has a continuous or uninterrupted exterior side, e.g. surface, defined by the exterior side of the sidewall 512 of the bowl 510, the exterior side of the coupling 570, and the exterior side of the sidewall 552 of the tube 550. Specifically, at the coupling 570, as shown in detail in FIG. 24, the second edge 559 of the sidewall 552 of the tube 552 is received at a receiving portion 573 of the annular ridge 522. The receiving portion 573 is configured to cooperate with the second edge 559, such that the exterior surfaces of the coupling 570 adjacent the collar 572 and annular ridge 522 are uninterrupted. That is to say that at the exterior surface, the seam between the second edge 559 and the receiving portion 573 is aesthetically substantially free of any breaks, gaps or irregularities. As such the assembled embodiment 500 will appear as though it was formed of a single, uninterrupted body having an outwardly projected decorative ring at the widest point of the embodiment 500, i.e. the location of the coupling 570, rather than being formed of two-piece construction, i.e., a coupled bowl 510 and tube 550. In such an embodiment, the resultant beverage receptacle of embodiment 500, when assembled will provide an exterior esthetic appearance comparable to a single piece stemless wine glass.

Figure 27:
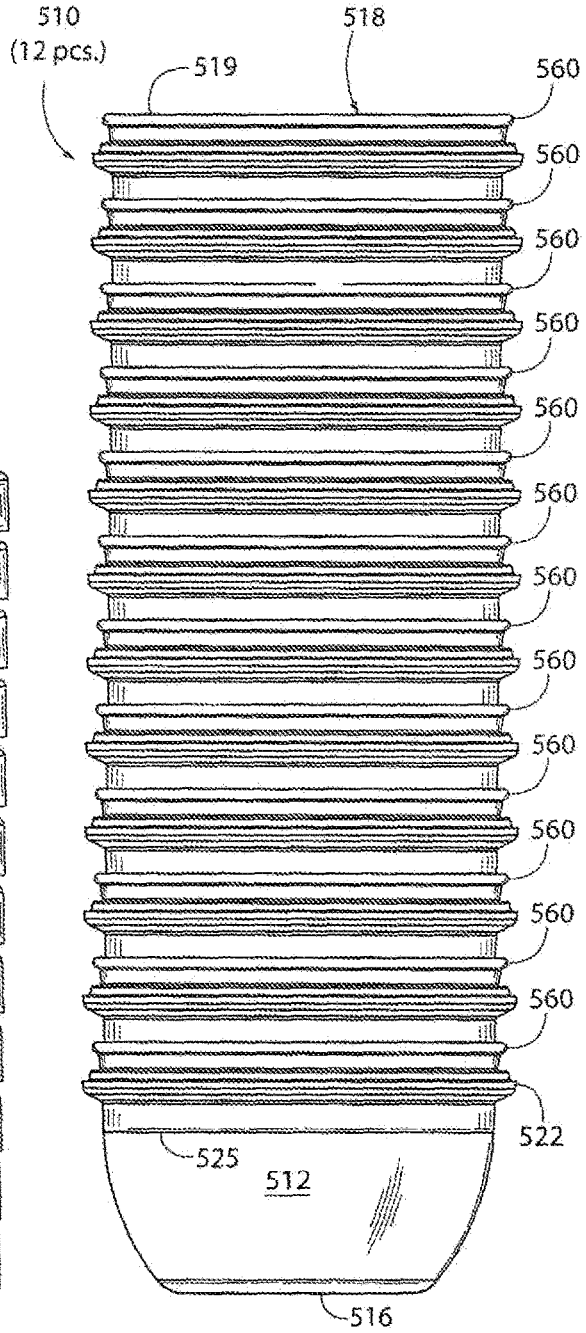
FIG. 27 is a front side elevation view of a plurality of drinkware bowl portions nested together, according the fifth embodiment of stackable drinkware of the present invention.

The coupling 570 is preferably provided circumjacent the maximum cavity width 508 to enhance nesting and stackability of the bowl 510 and tube 550, individually. This maximum width 508 is preferably provided at or near the open top 518 of the bowl 510 and/or the open bottom 556 of the tube 550. In any event, the coupling 570 and/or maximum width 508 is preferably provided at a predetermined location along the height 502 of the beverage receptacle embodiment 500, such as about 25% to about 50% of the height 502 as measured from the closed vessel bottom 516. For example, in an embodiment 500 having a height 502 of about four inches preferably includes a coupling 570 having at least a portion located between about one inch from the bottom 516 and about two inches from the bottom. As shown in FIGS. 27 and 29, a plurality of the bowls 510 are configured to be partially nested within one another as to accommodate space saving stacking of the bowls 510 during shipment or storage. In this stacked orientation, one bowl 510 may be placed or received within another bowl 510, such that the exterior side of the curved sidewall 512 of one bowl 510 is positioned adjacent the interior side of the curved sidewall 512 of the second bowl 510. This stacking of bowls 510 may include any number of nested or stacked bowls 510. Similarly, turning now to FIGS. 26 and 28, a plurality of the tubes 550 are also configured to be partially nested within one another as to accommodate space saving stacking of the tubes 550 during shipment or storage. In this stacked orientation, one tube 550 may be placed or received within another tube 550, such that the exterior side of the curved sidewall 552 of one tube 550 is positioned adjacent the interior side of the curved sidewall 552 of the second tube 550. This stacking of tubes 550 may include any number of nested or stacked tubes 550.

Figure 28:
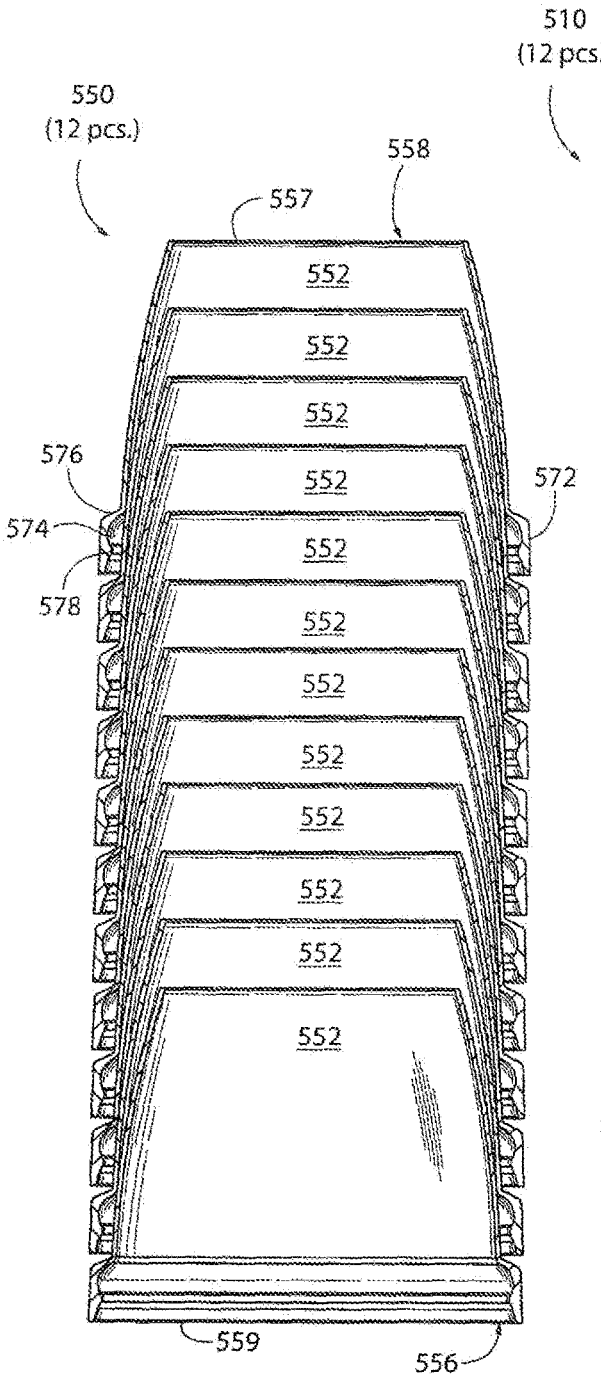
FIG. 28 is a cross-section view of the nested plurality of drinkware tube portions of FIG. 26.
Figure 29:
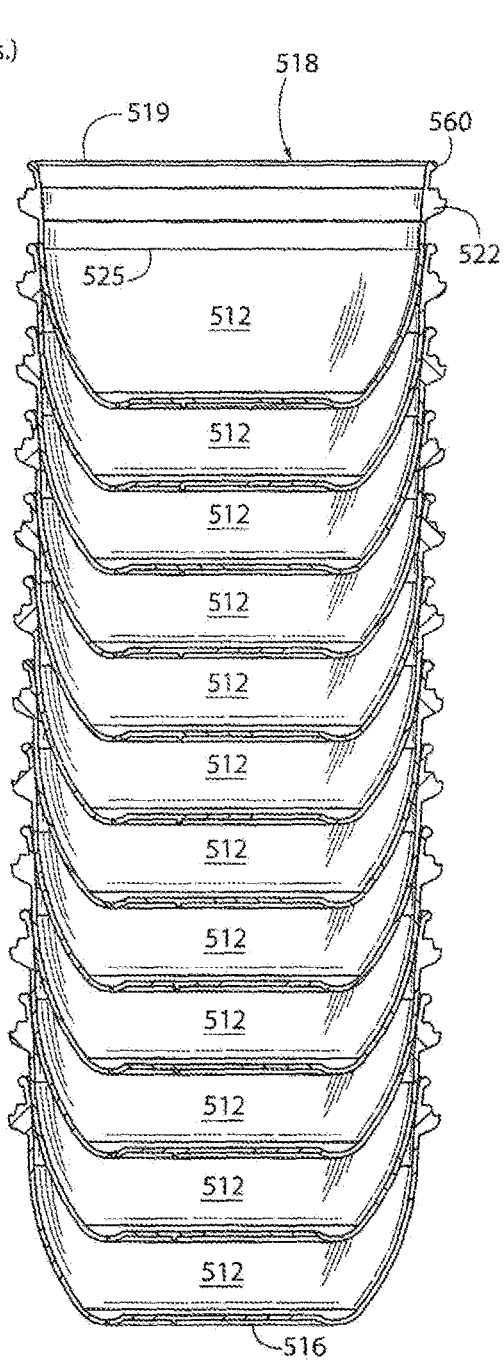
FIG. 29 is a cross-section view of the nested plurality of drinkware bowl portions of FIG. 27.

FIGS. 26-29, and specifically cross sectional FIGS. 28 and 29, further demonstrate the stackability of the components 510, 550 according to the fifth embodiment 500. Preferably, the bowl 510 and tube 510 components according to the present invention have a desirable stacking factor. As was described above in further detail, a stacking factor, as used herein, is equal to the number of components that may be nested within a space defined by a component footprint area multiplied by twice the height of the component. With respect to the fifth embodiment 500, the stacking factor of the tube 550 is preferably about 4 to about 10, with about 6 to 8 being most preferred, whereas the stacking factor of the bowl 510 is at least four and preferably approximately 4 to approximately 6. As was previously mentioned, the stacking factor will vary among the different embodiments of this invention, but minimally the stacking factor will be at least 4 for all embodiments of this invention. The foregoing is considered as illustrative only of the principles of the invention. Furthermore, since numerous modifications and changes will readily occur to those skilled in the art, it is not desired to limit the invention to the exact construction and operation shown and described. While the preferred embodiment has been described, the details may be changed without departing from the invention. For instance, the coupling collar 172, 272, 372 is described as being preferably disposed on the vessel 110, 210, 310, but it may alternatively be disposed on the chute 150, 250, 350. Similarly, the coupling collar 572 is described as being preferably disposed on the tube 550, but it may alternatively be disposed on the bowl 510. Additionally or alternatively, the pre-filled embodiment 400 may be provided with the fluid 430 in the chute 450, which has been sealed at one or both ends 456, 458.

Figure 30:
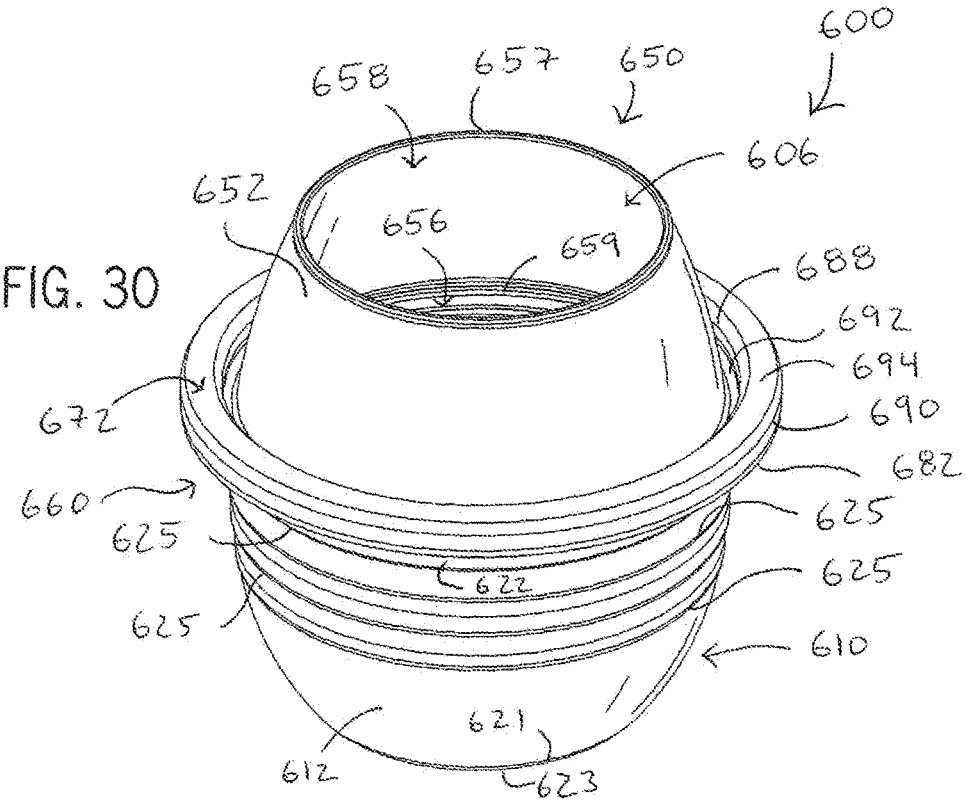
FIG. 30 is a perspective view of a sixth embodiment of stackable drinkware according to the present invention.

Turning now to FIGS. 30-38 and initially FIG. 30 a sixth embodiment 600 of stackable drinkware, i.e. a beverage receptacle such as a wine glass, is illustrated, where similar reference numerals refer to similar or identical structure as compared to the first embodiment 100. Generally, the drinkware or beverage receptacle according to the sixth embodiment 600 of the present invention includes a bowl 610, also identified as a bottom fluid vessel in some of the preceding embodiments, and a tube 650, which is also identified as a chute in some of the preceding embodiments, that is attachable, and preferably removably attachable, to the bowl 610. When the tube 650 is coupled to the bowl 610, the beverage receptacle embodiment 600 preferably has an overall height 602 and defines a fluid reservoir or capacity 606 having a maximum width 608 measured perpendicular to the height 602. A preferred overall height 602 of the sixth embodiment 600 of the stackable drinkware is approximately between 3.0 inches and 4.5 inches, and more preferably about 3.3 inches. A preferred maximum width 608 of the sixth embodiment 600 of the stackable drinkware is approximately between 3.0 inches and 4.0 inches, and more preferably about 3.75. A preferred capacity 606 of the sixth embodiment 600 of the stackable drinkware is approximately between 10 fluid ounces and 15 fluid ounces, and more preferably about 12 fluid ounces.

The bowl 610 generally includes a curved sidewall 612 that is inwardly concave relative to a central longitude axis of the embodiment 600. The curved sidewall 612 of the bowl 610 extending through the bowl height 614 between an open top 618 of the bowl 610 at a first edge 619 of the sidewall 612 and the closed bowl bottom surface 616 at a second edge 621 of the sidewall 612. The open top 618 of the bowl 610, defined by the first edge 619 has an interior width 627, which is preferably between 2.8 inches and 3.5 inches, with about 3.2 inches being most preferred. The closed bottom surface 616 of the bowl 610, defined by the second edge 621 has an interior width 629, which is preferably between 1.5 inches and 2.5 inches, with about 1.8 inches being most preferred. The sidewall 612 has a minimum sidewall thickness 512*a*, which is preferably between 0.01 inches and 0.06 inches, with about 0.04 millimeters being most preferred. A preferred height 614 of the sidewall 612 is about 1.75 inches to about 2.25 inches, with about 2.0 inches being most preferred.

The closed bowl bottom surface 616 may be defined within an outer circumferential edge 623 that is connected, integral with or otherwise connected to the second edge 621 of the sidewall 612. The closed bowl bottom surface 616 may also be provided with one or more inwardly extending dimples 620, which may provide structural support to the bowl 610, and such one or more dimples 620 may occupy a majority of the exterior side or surface area of the closed bottom surface 616.

The bowl 610 may be provided with one or more annular ridges 622, which may be integrally formed with the exterior side of the sidewall 612 and extend outwardly therefrom. The annular ridge(s) 622, of which there are two shown in the illustrated embodiment 600 of FIG. 31, preferably circumscribe the open bowl top 618 and are slightly offset from but adjacent the first edge 619. That is to say that the one or more of ridges 622 is positioned along the exterior side of the sidewall 612 near the first edge 619, and is preferably at least closer to the top 618 of the bowl 610 than the closed bottom surface 616, as shown in FIGS. 30-35. The one or more annular ridge(s) 622 may provide additional structural integrity to the bowl 610 as to minimize the deflection or flexion of the bowl 210 when assembles with tube 650, as will be described in further detail below. That is to say that the one or more annular ridge(s) 622 provide increased rigidity about the top 618 of the bowl 610 as to maintain a fluid tight seal between the bowl 610 and the tube 650 when the sixth embodiment 600 of the drinkware is assembled.

Figure 31:
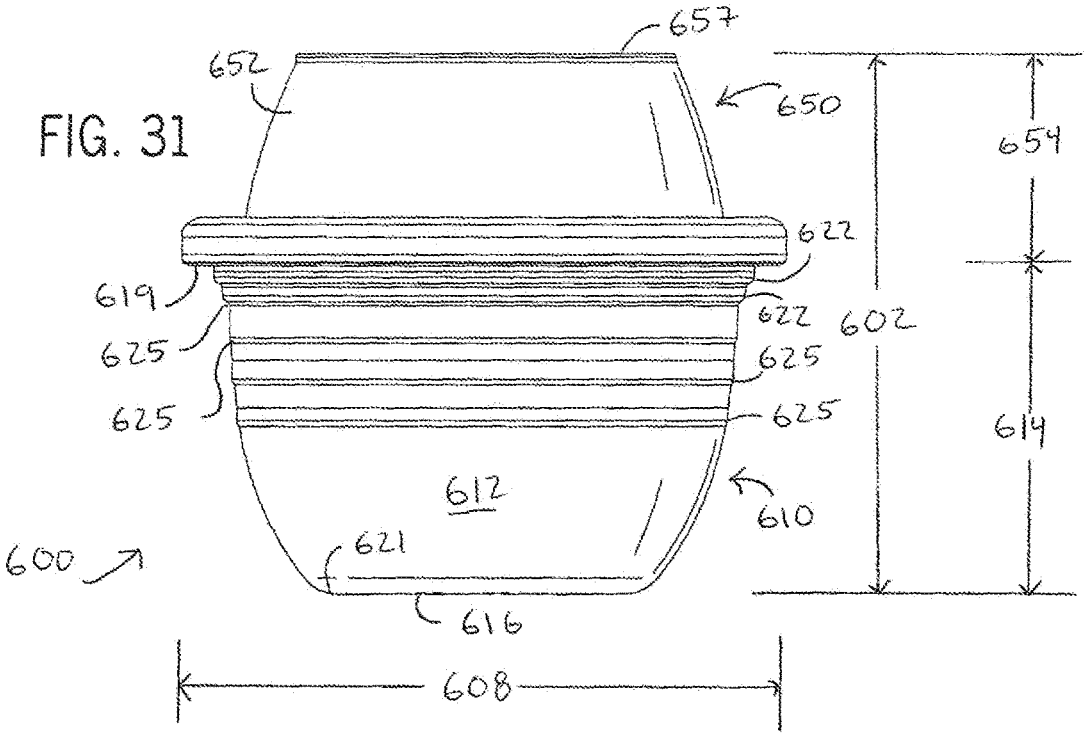
FIG. 31 is a front side elevation view of the embodiment of FIG. 30.
Figure 32:
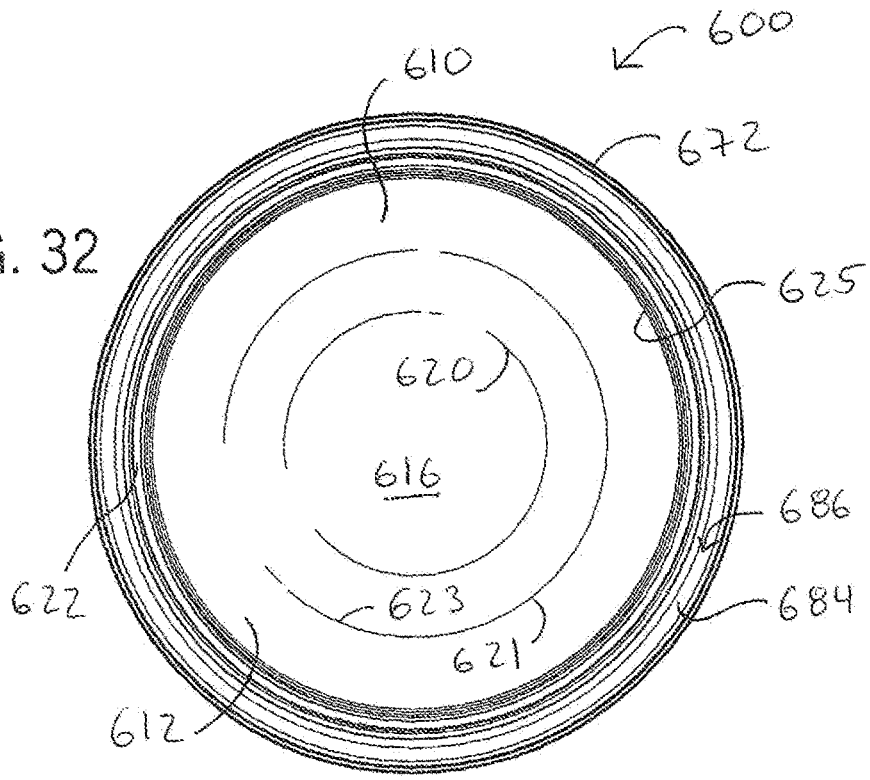
FIG. 32 is a bottom plan view of the embodiment of FIG. 30.
Figure 33:
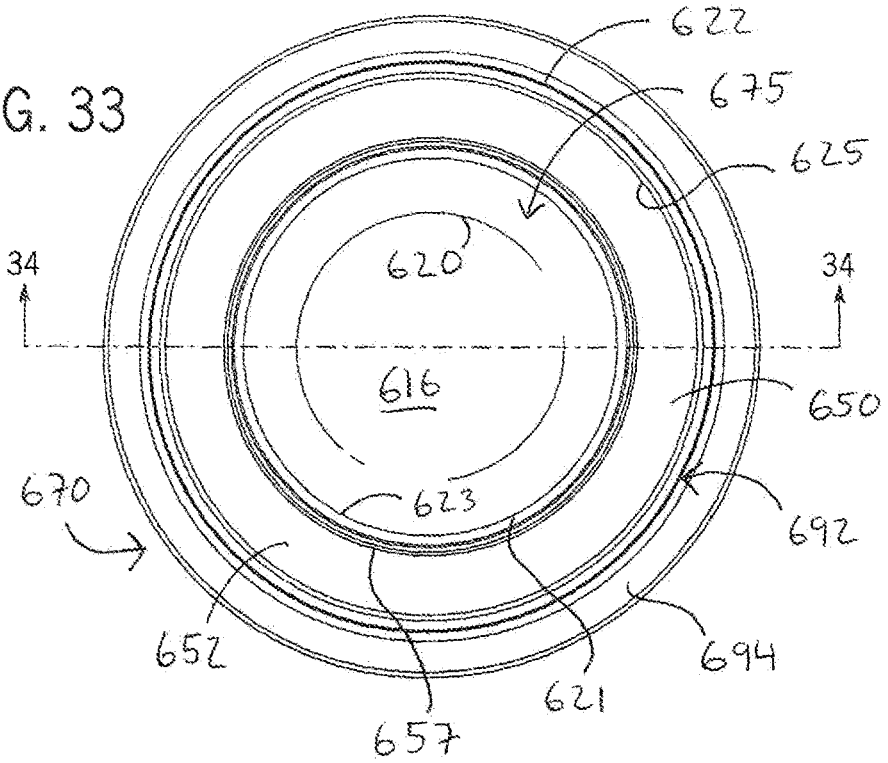
FIG. 33 is a top plan view of the embodiment of FIG. 30.

Still referring to FIGS. 30 and 31, one or more indicia 625 may be located at positions about the height 614 of the sidewall 612 of the bowl 610, wherein the indicia 625 indicate a predetermined fluid volume within the fluid reservoir. For example, the indicia 625 may indicate a given number of fluid ounces to assist in filling the fluid reservoir with a corresponding volume of fluid. Four indicia 625 are shown in the illustrated example of embodiment 600 in FIG. 31, however any number of indicia 625 are considered within the scope of the present invention. In one embodiment 600 of the present invention where the capacity 606 is preferably about 12 fluid ounces, the indicia 625 may identify predetermined capacity of 3.0, 4.0, 5.0, and 6.3 fluid ounces. Accordingly, the user of the drinkware of embodiment 600 may select from any one of the three indicia 625 to assist in accurately pouring the desired volume of fluid. Still referring to FIG. 31, the indicia 625 may be configured in a step-wise orientation, with the indicia 625 nearest the bottom surface 616 having the smallest circumference and the indicia 625 nearest the top 618 having the largest relative circumference, as to facilitate in extraction of the bowl 610 during injection molded plastic fabrication of the drinkware. Additionally, the indicia may provide additional structural stability and enhance the overall rigidity of the bowl 610, in addition to providing fluid volume indications. In an alternative embodiment, not shown, the indicia 625 may be alternatively or additionally located at positions about the sidewall 652 of the tube 650 or on the coupling collar 672 of the tube 650, described in detail below.

Figure 34:
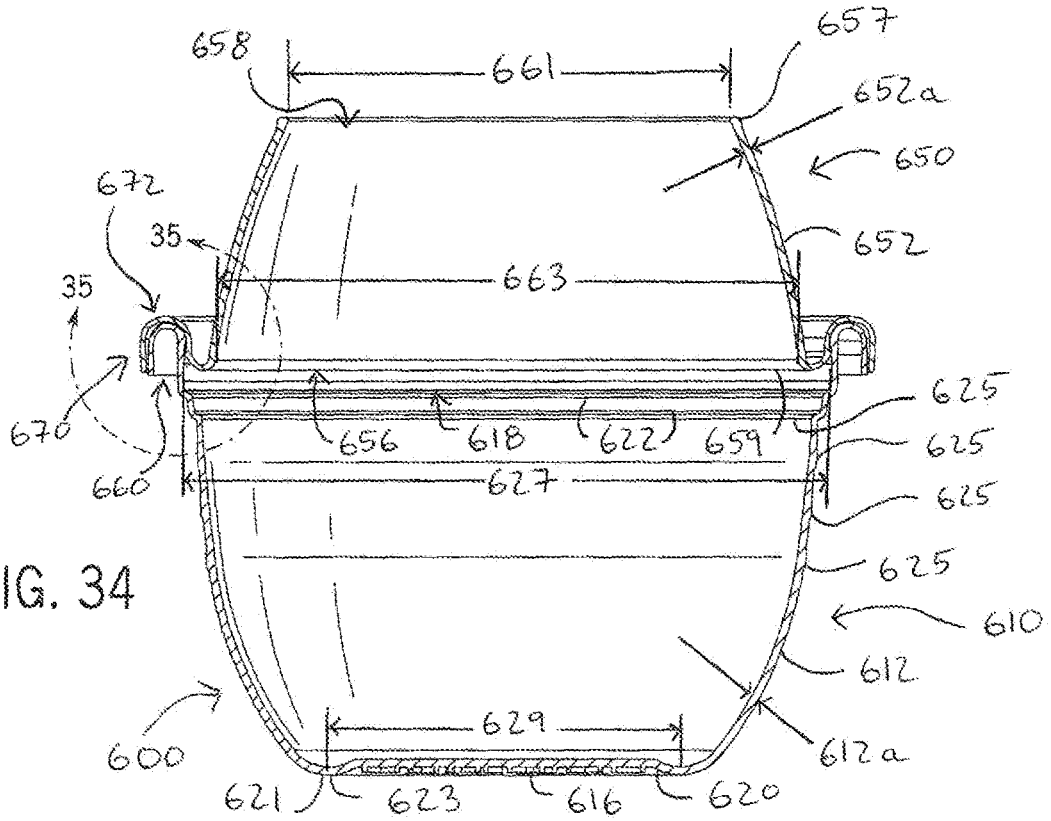
FIG. 34 is a cross-section view taken along line 34-34 of FIG. 33.
Figure 35:
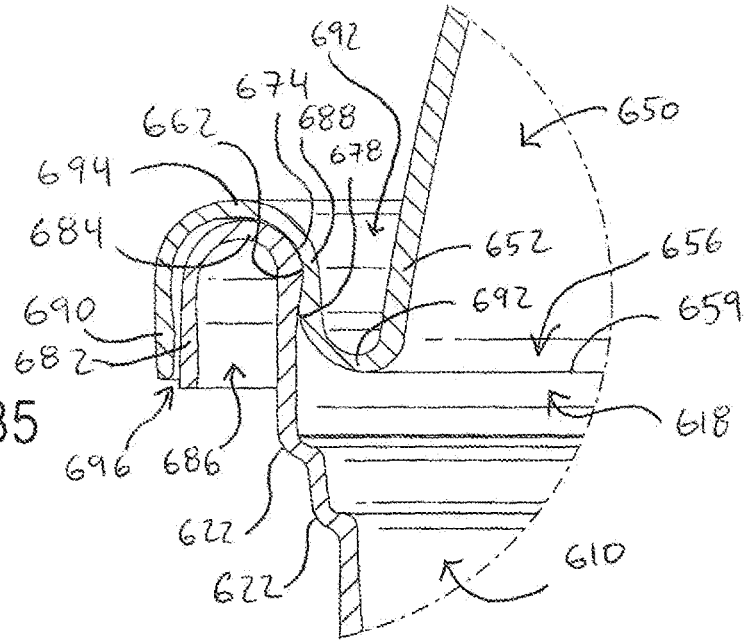
FIG. 35 is a partial cross-section view of the FIG. 35 section called out on FIG. 34.

As shown in FIG. 34, the bowl top 618 preferably includes a circumferential rim 660, which may comprise a medial wall 680, and distal wall 682, and a transverse wall 684 that extends between the medial wall 268 and the distal wall 682, where the radially extending ridge 662 is formed integrally with the medial wall 280 and extends inwardly from the inner surface of the medial wall 682 of the bowl 610. As shown in FIGS. 34 and 35, the circumferential rim 660 of the embodiment 600 is generally disposed in an inverted "U" shaped cross-section, with the medial wall 680 and the distal wall 682 defining the generally linear legs of the inverted "U" shaped cross-section, and the transverse wall 684 being a curved wall defining the curved central portion of the inverted "U" shaped cross-section. The circumferential rim 660 shown in FIGS. 34 and 35 further defines a lower interstitial space 686 that is bordered on three sides by and located underneath the walls 680, 682, 684 of the circumferential rim 660.

Turning now to the tube 650 of the sixth embodiment 600, the tube 650 generally includes a curved sidewall 652 that is inwardly concave relative to the central longitude axis of the embodiment 600. The curved sidewall 652 extends generally along a tube height 654 between a first edge 657 that defines an open tube top 658 and a second edge 659 that defined an open tube bottom 656. The height 654 of the tube 650 is preferably between 1.5 inches and 3.25 inches, with about 1.2 inches being most preferred. The first edge 657 of side wall 652 of the tube 650 defines an open top 658, i.e. the opening at the top of the beverage receptacle of embodiment 600, which has an area that is less than an area of the open bottom 656 that is defined by the second edge 659 of side wall 652 of the tube 650. The open top 658 of the tube 650, defined by the first edge 657 has an interior width 661, which is preferably between 2.0 inches and 3.0 inches, with about 2.5 inches being most preferred. The open bottom 656 of the tube 650, defined by the second edge 659 has an interior width 663, which is preferably between 2.5 inches and 4.0 inches, with about 3.0 inches being most preferred. In one alternative embodiment, not shown, sidewall 652 may be frustoconical, or it may have a large radius, such as about three to four times the height 602 of the embodiment 600, as described in prior embodiments. The sidewall 652 preferably has a minimum tube sidewall thickness 652*a*, which is preferably between 0.03 inches and 0.06 inches, with about 0.04 inches being most preferred.

As shown in FIG. 34, and will be discussed in further detail below, the tube bottom 656, defined by the second edge 659, preferably includes a radially circumferential coupling collar 672 radially extending from the bottom 656 of the tube 650. Still referring to FIG. 34, the first edge 657 of the tube 650, defining the tube top 658, may be rounded in a manner consistent with the circumferential rounded edge 163 of the first embodiment 100. Alternatively, while not shown, the first edge 657 located about the tube top 658 may be substantially flush relative to the tube sidewall 652, in a manner consistent with the circumferential rounded edge 563 of the fifth embodiment 500. The edge 657 preferably surrounds or forms a part of the open top 658 of the tube 650, the opening having a diameter defined by the width 661, that is less than the maximum width 608 of the drinkware of the sixth embodiment 600, and more preferably about 60% to about 80%, and most preferably about 65% to about 70%, of the width 608. Alternatively, the open top 658 may be formed by a portion of the sidewall 652 curled inwardly or outwardly backwards towards the tube bottom 656 and/or sidewall 652 to form a generally J-, P-, or hook-shaped cross-section. For example, in the embodiment shown in FIG. 34, the first edge 657 that defined the open top 658 does include a slight :P"-shaped cross-section. In one embodiment of the present invention, the edge 657 of the sidewall 652 is configured to receive a removable lid, as was described in prior embodiments of the present invention. The lid may be configured to cover the entire open top 658 of the tube 650 as to prevent fluid from exiting the beverage receptacle of embodiment 600. Alternatively, the lid may be configured to cover a portion of the open top 658 of the tube 650, thereby allowing a straw to be inserted through the lid, or allow a portion of fluid to exit the beverage receptacle of embodiment 600 through an aperture having an area smaller than the area of the open top 658 of the tube 650.

Referring now to FIGS. 34 and 35, the bowl 610 and tube 650 may be joined at a coupling 670, including mating portions disposed on the bowl 610 and tube 650, respectively. Generally, the relative location of the components of the coupling 670, namely the collar 672 and rim 660, are reversed relative to the first embodiment 100, in which the coupling collar 172 extends from the vessel 110, i.e., bowl, and the rim 160 is provided about the bottom 156 of the chute 150, i.e., tube. That is to say, in the sixth embodiment 600, the coupling 670 includes a coupling collar 672 located at or extending near the bottom 656 of the tube 650 and a rim 660 provided about the open top 618 of the bowl 610.

The rim 660 is configured to be received within the collar 672 to form a fluid tight seal. As shown in detail in FIG. 35, the collar 672 may comprise medial wall 688, and distal wall 690, a first transverse wall 692 that extends between the sidewall 652 and the medial wall 688, and a second transverse wall 294 that extends between the medial wall 288 and the distal wall 690. An annular retaining ridge 678 is formed integrally therewith the collar 672, and extends outwardly from the outer or mating surface of the medial wall 688 of the tube 650. As shown in FIGS. 34 and 35, the receiving collar 672 of the embodiment 600 is generally disposed in an sideways "S" shaped cross-section, with the lower portion of the sidewall 652, the medial wall 688, and the distal wall 690 defining the three generally parallel lengths of the sideways "S" shaped cross-section, and the first and second transverse walls, 692, 294 being the curved walls defining the opposing curved sections of the sideways "S" shaped cross-section. The receiving collar 672 shown in FIGS. 34 and 35 further defines a first interstitial space 692 that is bordered on three sides by the walls 652, 692, 688 of the receiving collar 672 and is located generally above the first transverse wall 692. The receiving collar 672 also defines a second interstitial space 696 that is bordered on three sides by the walls 688, 694, 690 of the receiving collar 672, and is located generally below the second transverse wall 694. That is to say that the first interstitial space 692 is open to atmosphere at its top while the second interstitial space 694 is open to atmosphere at its bottom. As shown in FIGS. 34 and 35, the second interstitial space 696 is generally configured to receive the circumferential rim 660 when the bowl 610 and tube 650 are secured together in a water tight seal at the coupling 670 as described in further detail below.

As was described above, the annular retaining ridge 678 of the receiving collar 672 is formed integrally with the medial wall 688 of the tube 650, and extends outwardly from the outer or mating surface of the medial wall 688 and into the second interstitial space 696. In embodiment 600, the collar 672 of the tube 650 may also include a receiving area 674 on the mating surface of the medial wall 688 disposed between the annular retaining ridge 678 and the second transverse wall 694. In one embodiment of the present invention, the annular retaining ridge 678 extends beyond the receiving area 674, and into the second interstitial space 696, by a distance of approximately 0.125 millimeter and 0.5 millimeter, and more preferably 0.25 millimeter. The receiving area 674 has an outer engaging or mating surface with a circumference that is smaller than the circumference of the adjacent mating surface of the annular retaining ridge 678. In one embodiment of the present invention, the circumference of the outer engaging or mating surface of the receiving area 674 is smaller than the circumference of the adjacent mating surface of the annular retaining ridge 678 by a distance of approximately 0.25 millimeter and 1.0 millimeter, and more preferably 0.5 millimeter.

Still referring to FIGS. 34 and 35, in one preferred embodiment, the circumference of the outer facing engaging or mating surface of the annular retaining ridge 678 of the collar 672 is greater than the circumference of both the outer facing engaging or mating surface of the receiving area 674 and the inner facing engaging or mating surface of the annular retaining ridge 662 of the rim 660, as to maintain a frictional engagement between the radially extending ridge 662, the annular retaining ridge 662, and the receiving area 674 when the drinkware of the sixth embodiment 600 is assembled. That is to say, that the circumference of the inner facing mating surface of the radially extending ridge 662 of the circumferential rim 660 on the bowl 610 is smaller than the circumference of the outer facing mating surface of the annular retaining ridge 678 by a distance of approximately 0.25 millimeter and 1.0 millimeter, and more preferably 0.5 millimeter. Accordingly, in the assembled configuration, the inner facing or mating surface of the radially extending ridge 662 of the circumferential rim 660 on the bowl 610, is secured in the receiving area 674, between the second transverse wall 694 and retaining ridge 678, as shown in FIG. 35. To achieve this assembled configuration, shown in FIGS. 34 and 35, the bowl 610 and tube 650 are pushed together. As a result of the opposing forces applied to the bowl 610 and tube 650, a slight deflection or flexing of the radially extending ridge 662 of the circumferential rim 660 on the bowl 610 and/or the annular retaining ridge 678 of the collar 672 on the tube 650 allows the radially extending ridge 662 to slide over the annular retaining ridge 678 and be seated in the receiving area 674. When assembled the radially extending ridge 62 and the annular retaining ridge 678 circumferentially overlap, thereby maintaining the fluid tight seal of the coupling 670.

That is to say, when assembling the beverage receptacle of embodiment 600, the rim 660, or more specifically the mating surface of the radially extending ridge 662 thereof, which has an inner circumference larger than the exterior circumference of the mating surface of the annular ridge 678, is configured to deflect about the annular ridge 678, while the bowl 610 and tube 650 are pressed together. After the radially extending ridge 662 of the rim 660 has traveled past the location of the annular ridge 678, the rim 660 expands outwardly to engage the exterior or mating surface of the receiving area 674. As a result, the rim 660 is received generally within the second interstitial space 696 of the collar 672. In this mated configuration, with the circumference of the radially extending ridge 662 expanded beyond its resting circumference, the medial wall 680 of the rim 660 may continually apply an inwardly directed pressure, i.e., a spring force, on the medial wall 688 of the collar 672, as it attempts to return to its resting circumference. Similarly, or alternatively, in the mated configuration, with the circumference of the annular retaining ridge 678 compressed to a distance less than its resting circumference, the medial wall 688 of the collar 672 may continually apply an outwardly directed pressure, i.e., a spring force, on the medial wall 680 of the rim 660, as it attempts to return to its resting circumference. As a result of one or both of these spring forces, the rim 660 and collar 672 of the coupling 670 form a water tight seal.

As shown in FIGS. 34 and 35 the inverted "U" shaped cross-section of the circumferential rim 660 is generally received within the second interstitial space 696 of the sideways "S" shaped cross-section of the coupling collar 672. Furthermore, in the mated configuration and as shown in FIG. 35, the upper facing engaging or mating surface of the transverse wall 684 of the circumferential rim 660 may engage a portion of the lower facing engaging or mating surface of the second transverse wall 694 of the collar 672, thereby providing additional contact between the rim 660 and the collar 672 to form a fluid tight seal at that coupling 670. Still further, while not shown in FIG. 35, the outwardly facing engaging or mating surface of the distal wall 682 of the circumferential rim 660 may engage a portion of the inner facing engaging or mating surface of the distal wall 690 of the collar 672, thereby providing additional contact between the rim 660 and the collar 672 to form a fluid tight seal at that coupling 670.

When assembled, engagement of the radially extending ridge 662 against the annular retaining ridge 662, and the receiving area 674 may form an audible snap closure at the coupling 670, as the radially extending ridge 662 of the rim 660 passes over the annular retaining ridge 678 of the collar 672, and preferably forms a fluid tight seal. That is to say that the frictional contact between the radially extending ridge 662, the annular retaining ridge 678, and the receiving area 674, when assembled, is sufficient to maintain a seal to prevent leakage of a liquid or fluid (e.g. a beverage such as water or wine) out of the cavity 606 through the coupling 670. In this assembled or mated configuration the radially extending ridge 662 of the rim exerts an inwardly directed compression force against the receiving area 674 and/or the annular retaining ridge 662 of the collar 672 around the circumference of the drinkware. The compression force is applied in a direction generally perpendicular to a central longitudinal axis of the drinkware.

Once the bowl 610 and tube 650 have been connected together via engagement of the rim 660 and collar 672, a fluid reservoir 675 is formed within the beverage receptacle embodiment 600, defined by the interior side of the bottom surface 616, the interior side of the sidewall 612 of the bowl 610 and the interior side of the curved sidewall 652 of the tube 650. Additionally or alternatively, a gasket material (not shown) may be disposed between the bowl 610 and the tube 650 at the coupling 670 to assist in the seal.

The coupling 670 is preferably provided circumjacent the maximum cavity width 608 to enhance nesting and stackability of the bowl 610 and tube 650, individually. This maximum width 608 is preferably provided at or near the open top 618 of the bowl 610 and/or the open bottom 656 of the tube 650. Furthermore, increased stability of the coupling and decreased flexibility of the tube 650 is experienced when the coupling 670 is located about the upper half of the height 602. Accordingly, the coupling 670 and/or maximum width 608 is preferably provided at a predetermined location along the height 602 of the beverage receptacle embodiment 600, such as in one preferred embodiment about 25% to about 50% of the height 602 is comprised of the height 654 of the tube 654, and in a more preferred embodiment about 33% of the height 602 is comprised of the height 654 of the tube 654. For example, in an embodiment 600 having a height 602 of about four inches preferably includes a coupling 670 having at least a portion located between about one inch from the bottom 616 and about two inches from the bottom 616.

Figure 37:
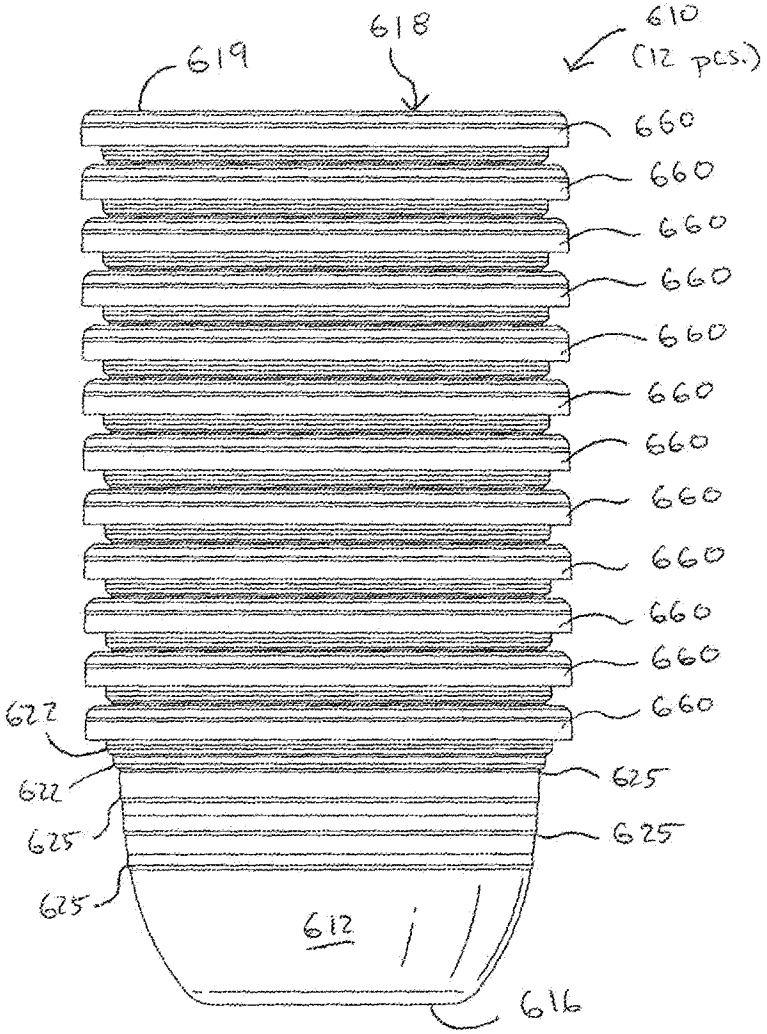
FIG. 37 is a front side elevation view of a plurality of drinkware bowl portions nested together, according the sixth embodiment of stackable drinkware of the present invention.
Figure 36:
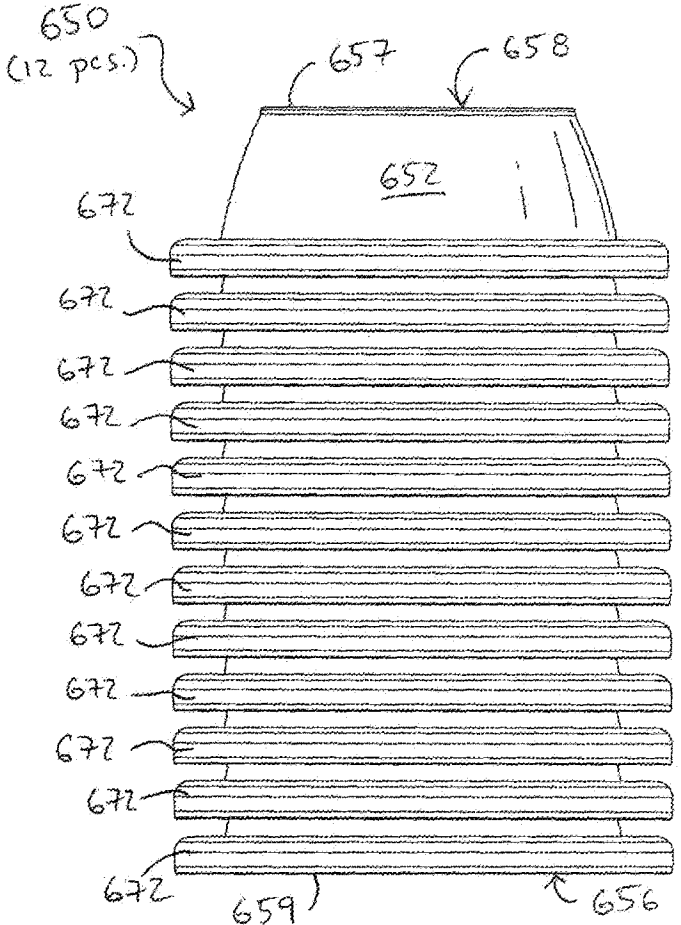
FIG. 36 is a front side elevation view of a plurality of drinkware tube portions nested together, according the sixth embodiment of stackable drinkware of the present invention.

As shown in FIG. 36, a plurality of the tubes 650 are configured to be partially nested within one another as to accommodate space saving stacking of the tubes 650 during shipment or storage. In this stacked orientation, one tube 650 may be placed or received within another tube 650, such that the exterior side of the curved sidewall 652 of one tube 650 is positioned adjacent the interior side of the curved sidewall 652 of the second tube 650. This stacking of tubes 650 may include any number of nested or stacked tubes 650. Similarly, as shown in FIG. 37, a plurality of the bowls 610 are configured to be partially nested within one another as to accommodate space saving stacking of the bowls 610 during shipment or storage. In this stacked orientation, one bowl 610 may be placed or received within another bowl 610, such that the exterior side of the curved sidewall 612 of one bowl 610 is positioned adjacent the interior side of the curved sidewall 612 of the second bowl 610. This stacking of bowls 610 may include any number of nested or stacked bowls 610.

FIGS. 36 and 37, further demonstrate the stackability of the components 610, 650 according to the sixth embodiment 600. Preferably, the bowl 610 and tube 650 components according to the present invention have a desirable stacking factor. As was described above in further detail, a stacking factor, as used herein, is equal to the number of components that may be nested within a space defined by a component footprint area multiplied by twice the height of the component. With respect to the sixth embodiment 600, the stacking factor of the tube 650 is preferably about 4 to about 10, with about 4 to 6 being most preferred, whereas the stacking factor of the bowl 610 is at least 4 and preferably approximately 4 to approximately 7. As was previously mentioned, the stacking factor will vary among the different embodiments of this invention, but minimally the stacking factor will be at least 4 for all embodiments of this invention.

Figure 38:
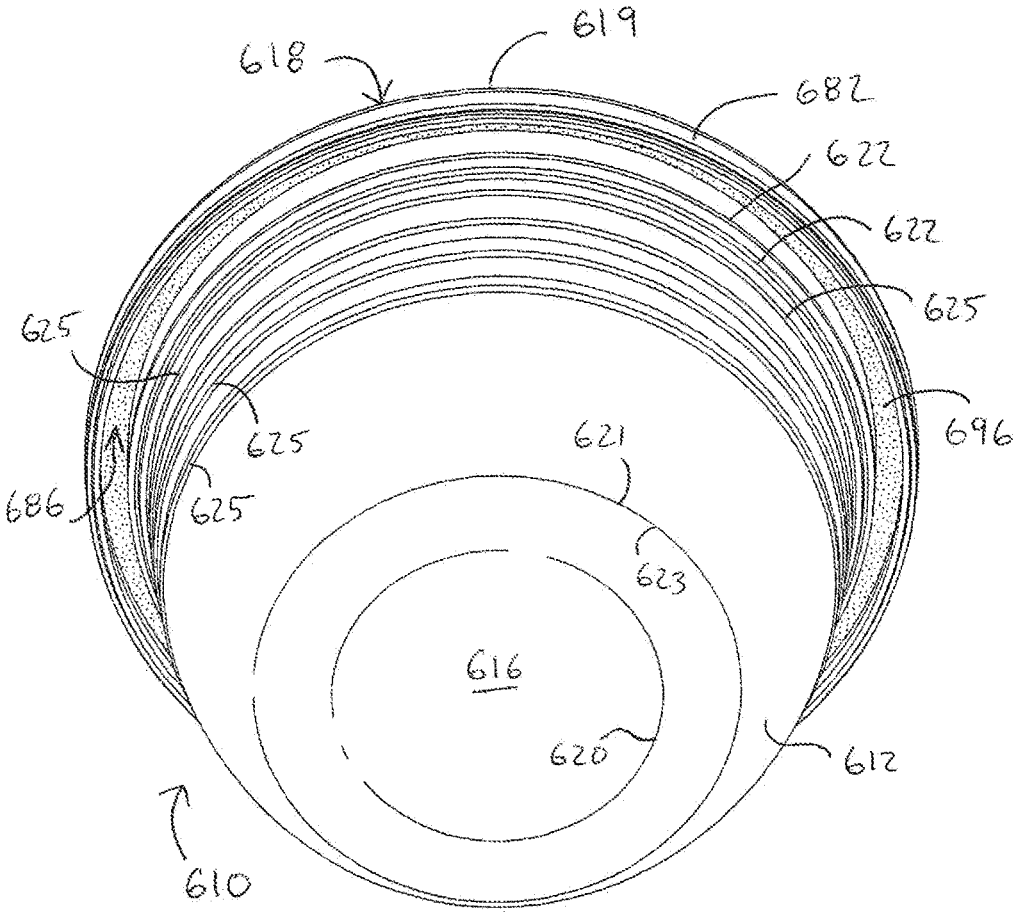
FIG. 38 is a bottom perspective view of the drinkware bowl portion embodiment of FIG. 30, including a drinkware accessory.

Furthermore, turning now to FIG. 38, and as shown in FIGS. 30, 31 and 34, when assembled as described above, the resultant beverage receptacle of embodiment 600 has an exterior side, e.g. surface, defined by the exterior side of the sidewall 612 of the bowl 610, the exterior side of the coupling 670, and the exterior side of the sidewall 652 of the tube 650. At the coupling 670, the first interstitial space 692 of the collar 276 and the interstitial space of the circumferential rim 660 will be exposed to atmosphere. That is to say that the upwardly oriented first interstitial space 692 of the collar 276 and the downwardly oriented interstitial space 686 of the circumferential rim 660 will be accessible to a user of the beverage receptacle of embodiment 600. Accordingly, in one embodiment of the present invention, as illustrated in FIG. 38, the downwardly oriented interstitial space 286 of the circumferential rim 660 is configured to receive a drinkware accessory 696 within the space 286. As shown in FIG. 38, in one embodiment of the present invention, the drinkware accessory 696 is a cord having a cross sectional diameters approximately equal to the width of the downwardly oriented interstitial space 686 of the circumferential rim 660, such that the drinkware accessory 696 is received and retained within the interstitial space 686 by frictional engagement. In one preferred embodiment, the drinkware accessory 696 has a length approximately equal to the circumferential length of the interstitial space 686, such that the drinkware accessory 696 forms a ring that fills the interstitial space 686. In one embodiment, the drinkware accessory 696 may be formed of one or more colors, such that the drinkware accessory 696 constitutes a unique drinkware identifier. That is to say, when more than one drinkware is used amongst a plurality of users, a unique color drinkware accessory 696 may be associated with each individual user's drinkware such that the users can readily identify their own drinkware or glass. Alternatively, the drinkware accessory 696 may be formed a fluorescent or glow-in-the dark material.

In yet another embodiment of the present invention, a display area (not shown) may be disposed on exterior surface of the drinkware of the sixth embodiment 600. In one embodiment, the display area is a generally rectangular area located on the exterior surface of the sidewall 652 of the tube 650. The display area may be configured to receive a written, stamped, adhesively affixed display, or any alternative means of affixing a display to a surface as is known in the art. The display area may have a matte finish or alternative surface treatment to improve adhesion or retention of a display within the display area. In an alternative embodiment, the display are may alternatively or additionally located on the exterior surface of the sidewall 612 of the bowl 610.

The foregoing is considered as illustrative only of the principles of the invention. Furthermore, since numerous modifications and changes will readily occur to those skilled in the art, it is not desired to limit the invention to the exact construction and operation shown and described. While the preferred embodiment has been described, the details may be changed without departing from the invention. For instance, the coupling collar 172, 272, 372 is described as being preferably disposed on the vessel 110, 210, 310, but it may alternatively be disposed on the chute 150, 250, 350. Similarly, the coupling collars 572 and 672 as described as being preferably disposed on the tube 550, 650, but it may alternatively be disposed on the bowl 510, 610. Additionally or alternatively, the pre-filled embodiment 400 may be provided with the fluid 430 in the chute 450, which has been sealed at one or both ends 456, 458.

We claim:

1. A beverage receptacle, comprising:
a bowl having:
a closed bottom surface defined within an outer circumferential edge, the closed bottom surface having an interior side and an exterior side,
a first sidewall having
a first edge defining an opening having an area larger than an area defined within the outer circumferential edge of the closed bottom,
a second edge,
an interior side, and
an exterior side,
wherein the second edge of the first sidewall is affixed to the closed bottom surface about the outer circumferential edge; and
a removable tube configured to be attached to the bowl via a coupling disposed between the bowl and the removable tube, the removable tube having:
a second sidewall having
a first edge defining a first opening,
a second edge defining a second opening having an area larger than an area of the first opening,
an interior side, and
an exterior side,
wherein the coupling comprises:
a collar comprising
a medial wall, an opposing distal wall and a transverse wall extending between the medial wall and the distal wall, wherein the medial wall, the opposing distal wall and the transverse wall are arranged to define a first interstitial space, and
a portion of either the first sidewall of the bowl or the second sidewall of the removable tube, the portion oppositely facing the medial wall, and a second transverse wall extending between the medial wall and the opposing portion, wherein the medial wall, the opposing portion and the second transverse wall are arranged to define a second interstitial space which separates the medial wall from the opposing portion along the medial wall's length; and
a rim configured to be received within the first interstitial space of the collar and to form a fluid tight seal with the collar when the removable tube is attached to the bowl; and
wherein the collar engages the rim to form a fluid reservoir defined by the interior side of the bottom surface, the interior side of the first sidewall and the interior side of the second sidewall.

2. The beverage receptacle of claim 1, wherein at least one indicia indicative of a predetermined fluid volume within the fluid reservoir is located at a location on the beverage receptacle, wherein the location is selected from a position on the first sidewall, a position on the second sidewall and a position on the collar.

3. A wine glass, comprising:
a bowl having:
a closed bottom surface defined within an outer circumferential edge, the closed bottom surface having an interior side and an exterior side,
a first curved sidewall having
a first edge defining an opening having an area larger than an area defined within the outer circumferential edge of the closed bottom,
a second edge,
an interior side, and
an exterior side,
wherein the second edge of the first curved sidewall is affixed to the closed bottom surface about the outer circumferential edge; and
a removable tube configured to be attached to the bowl via a coupling disposed between the bowl and the removable tube, the removable tube having;
a second curved sidewall having
a first edge defining a first opening,
a second edge defining a second opening having an area larger than an area of the first opening,
an interior side, and an exterior side, wherein the second edge of the second curved sidewall engages the first edge of the first curved sidewall to form:

a fluid reservoir defined by the interior side of the bottom surface, the interior side of the first curved sidewall and the interior side of the second curved sidewall, and a continuous outer surface of the wine glass; wherein the coupling comprises:

a collar comprising:

a medial wall, an opposing distal wall and a transverse wall extending between the medial wall and the distal wall, wherein the medial wall, the opposing distal wall and the transverse wall are arranged to define a first interstitial space, and a portion of either the first curved sidewall of the bowl or the second curved sidewall of the removable tube, the portion oppositely facing the medial wall, and a second transverse wall extending between the medial wall and the opposing portion, wherein the medial wall, the opposing portion and the second transverse wall are arranged to define a second interstitial space which separates the medial wall from the opposing portion along the medial wall's length; and a rim configured to be received within the first interstitial space of the collar and to form a fluid tight seal with the collar when the removable tube is attached to the bowl.

4. The wine glass of claim 3, wherein the bowl is a first bowl configured to nest within a second bowl in a stacked orientation, such that the exterior side of the curved first sidewall of the first bowl is positioned adjacent an interior side of a curved first sidewall of the second bowl; and wherein the removable tube is a first removable tube configured to nest within a second removable tube in a stacked orientation, such that the exterior side of the curved second sidewall of the first removable tube is positioned adjacent an interior side of a curved second sidewall of the second removable tube.

5. A beverage receptacle, comprising:

a bowl having a closed bottom surface, a sidewall, and a rim;

a tube having a sidewall and a collar;

wherein the collar comprises:

a medial wall, an opposing distal wall and a transverse wall extending between the medial wall and the distal wall, wherein the medial wall, the opposing distal wall and the transverse wall are arranged to define a first interstitial space, and a portion of the sidewall of the tube, the portion oppositely facing the medial wall, and a second transverse wall extending between the medial wall and the opposing portion, wherein the medial wall, the opposing portion and the second transverse wall are arranged to define a second interstitial space which separates the medial wall from the opposing portion along the medial wall's length; and wherein the rim is configured to be received within the first interstitial space of the collar and to form a fluid tight seal with the collar when the tube is attached to the bowl.

6. The beverage receptacle of claim 1, wherein the collar is part of the removable tube and extends from the second edge of the second sidewall, and the rim is part of the bowl and extends from the first edge of the first sidewall.

7. The beverage receptacle of claim 1, wherein the collar is part of the bowl and extends from the first edge of the first sidewall, and the rim is part of the removable tube and extends from the second edge of the second sidewall.

8. The wine glass of claim 3, wherein the collar is part of the removable tube and extends from the second edge of the second sidewall, and the rim is part of the bowl and extends from the first edge of the first sidewall.

9. The wine glass of claim 3, wherein the collar is part of the bowl and extends from the first edge of the first sidewall, and the rim is part of the removable tube and extends from the second edge of the second sidewall.

10. The beverage receptacle of claim 1, wherein the collar has a cross-section that is generally S-shaped having three generally parallel portions connected by two generally curved portions such that the opposing distal wall, the medial wall and the opposing portion of either the first sidewall or the second sidewall correspond to the three generally parallel portions and the first and second transverse walls correspond to the two generally curved portions.

11. The beverage receptacle of claim 1, wherein the rim comprises a rim distal wall, a second portion of either the first sidewall of the bowl or the second sidewall of the removable tube, the second portion oppositely facing the rim distal wall, and a rim transverse wall extending between the rim distal wall and the second opposing portion, and further wherein a mating surface on the medial wall of the collar and a mating surface on the second opposing portion of the rim are configured to form the fluid tight seal when the removable tube is attached to the bowl.

12. The beverage receptacle of claim 1, wherein the rim comprises a rim distal wall, a second portion of either the first sidewall of the bowl or the second sidewall of the removable tube, the second portion oppositely facing the rim distal wall, and a rim transverse wall extending between the rim distal wall and the second opposing portion, and further wherein a mating surface on the medial wall of the collar and a mating surface on the second opposing portion of the rim are configured such that the second opposing portion of the rim applies a force directed inwardly towards an interior of the beverage receptacle and the medial wall of the collar applies a force directed outwardly away from the interior of the beverage receptacle to form the fluid tight seal when the removable tube is attached to the bowl.

13. The beverage receptacle of claim 1, wherein the rim comprises a rim distal wall, a second portion of either the first sidewall of the bowl or the second sidewall of the removable tube, the second portion oppositely facing the rim distal wall, and a rim transverse wall extending between the rim distal wall and the second opposing portion, further wherein a mating surface on the medial wall of the collar comprises an annular retaining ridge having a circumference as measured from a center of the beverage receptacle to an outer facing surface of the annular retaining ridge and, further wherein a mating surface on the second opposing portion of the rim comprises a radially extending ridge having a circumference as measured from the center of the beverage receptacle to an inner facing surface of the radially extending ridge, wherein the circumference of the annular retaining ridge is greater than the circumference of the radially extending ridge so as to form the fluid tight seal when the removable tube is attached to the bowl.

14. The beverage receptacle of claim 1, wherein the rim comprises a rim distal wall, a second portion of either the first sidewall of the bowl or the second sidewall of the removable tube, the second portion oppositely facing the rim distal wall, and a rim transverse wall extending between the rim distal wall and the second opposing portion, the rim distal wall, the second opposing portion, and the rim transverse wall arranged to define a third interstitial space, wherein the beverage receptacle further comprises a drinkware accessory configured to be received within the third interstitial space.

15. The beverage receptacle of claim 1, the first sidewall of the bowl comprising one or more annular ridges positioned near the first edge of the first sidewall, the ridges extending outwardly from the exterior side of the first sidewall.

16. The wine glass of claim 3, wherein the collar has a cross-section that is generally S-shaped having three generally parallel portions connected by two generally curved portions such that the opposing distal wall, the medial wall and the opposing portion of either the first curved sidewall or the second curved sidewall correspond to the three generally parallel portions and the first and second transverse walls correspond to the two generally curved portions.

17. The wine glass of claim 3, wherein the rim comprises a rim distal wall, a second portion of either the first curved sidewall of the bowl or the second curved sidewall of the removable tube, the second portion oppositely facing the rim distal wall, and a rim transverse wall extending between the rim distal wall and the second opposing portion, and further wherein a mating surface on the medial wall of the collar and a mating surface on the second opposing portion of the rim are configured to form the fluid tight seal when the removable tube is attached to the bowl.

18. The wine glass of claim 3, wherein the rim comprises a rim distal wall, a second portion of either the first curved sidewall of the bowl or the second curved sidewall of the removable tube, the second portion oppositely facing the rim distal wall, and a rim transverse wall extending between the rim distal wall and the second opposing portion, and further wherein a mating surface on the medial wall of the collar and a mating surface on the second opposing portion of the rim are configured such that the second opposing portion of the rim applies a force directed inwardly towards an interior of the wine glass and the medial wall of the collar applies a force directed outwardly away from the interior of the wine glass to form the fluid tight seal when the removable tube is attached to the bowl.

19. The wine glass of claim 3, wherein the rim comprises a rim distal wall, a second portion of either the first curved sidewall of the bowl or the second curved sidewall of the removable tube, the second portion oppositely facing the rim distal wall, and a rim transverse wall extending between the rim distal wall and the second opposing portion, further wherein a mating surface on the medial wall of the collar comprises an annular retaining ridge having a circumference as measured from a center of the wine glass to an outer facing surface of the annular retaining ridge and, further wherein a mating surface on the second opposing portion of the rim comprises a radially extending ridge having a circumference as measured from the center of the wine glass to an inner facing surface of the radially extending ridge, wherein the circumference of the annular retaining ridge is greater than the circumference of the radially extending ridge so as to form the fluid tight seal when the removable tube is attached to the bowl.

20. The beverage receptacle of claim 5, wherein the collar has a cross-section that is generally S-shaped having three generally parallel portions connected by two generally curved portions such that the opposing distal wall, the medial wall and the opposing portion of the sidewall of the tube correspond to the three generally parallel portions and the first and second transverse walls correspond to the two generally curved portions.

21. The beverage receptacle of claim 5, wherein the rim comprises a rim distal wall, a second portion of the sidewall of the bowl, the second portion oppositely facing the rim distal wall, and a rim transverse wall extending between the rim distal wall and the second opposing portion, and further wherein a mating surface on the medial wall of the collar and a mating surface on the second opposing portion of the rim are configured to form the fluid tight seal when the tube is attached to the bowl.

22. The beverage receptacle of claim 5, wherein the rim comprises a rim distal wall, a second portion of the sidewall of the bowl, the second portion oppositely facing the rim distal wall, and a rim transverse wall extending between the rim distal wall and the second opposing portion, and further wherein a mating surface on the medial wall of the collar and a mating surface on the second opposing portion of the rim are configured such that the second opposing portion of the rim applies a force directed inwardly towards an interior of the beverage receptacle and the medial wall of the collar applies a force directed outwardly away from the interior of the beverage receptacle to form the fluid tight seal when the tube is attached to the bowl.

23. The beverage receptacle of claim 5, wherein the rim comprises a rim distal wall, a second portion of the sidewall of the bowl, the second portion oppositely facing the rim distal wall, and a rim transverse wall extending between the rim distal wall and the second opposing portion, further wherein a mating surface on the medial wall of the collar comprises an annular retaining ridge having a circumference as measured from a center of the beverage receptacle to an outer facing surface of the annular retaining ridge and, further wherein a mating surface on the second opposing portion of the rim comprises a radially extending ridge having a circumference as measured from the center of the beverage receptacle to an inner facing surface of the radially extending ridge, wherein the circumference of the annular retaining ridge is greater than the circumference of the radially extending ridge so as to form the fluid tight seal when the tube is attached to the bowl.

* * * * *